US006353419B1

(12) United States Patent
Gates et al.

(10) Patent No.: US 6,353,419 B1
(45) Date of Patent: Mar. 5, 2002

(54) ANTENNA DEPLOYER FOR RAISED MICROCELLS

(75) Inventors: Frank Vernon Gates, Succasunna, NJ (US); Daniella Ruth Rubinovitz, New York, NY (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/266,031

(22) Filed: Mar. 11, 1999

(51) Int. Cl.[7] ..... H01Q 1/12
(52) U.S. Cl. ..... 343/882; 343/878
(58) Field of Search ..... 343/882, 915, 343/874, 883, 875, 878, 890

(56) References Cited

U.S. PATENT DOCUMENTS 3,952,984 A * 4/1976 Dimitry ..... 248/282
3,959,795 A * 5/1976 Foster ..... 343/883
5,537,125 A * 7/1996 Harrell, Jr. et al. ..... 343/878

* cited by examiner

*Primary Examiner*—Tho Phan
*Assistant Examiner*—James Clinger

(57) ABSTRACT

A microcell having a plurality of antennas attached to an upper portion thereof is arranged to move along an interior of a guyed latticework tower. As the microcell is being raised, the antennas are in a stowed position within the confines of the tower structure. When the microcell reaches the top of the tower, the antennas are deployed by deploying mechanisms which utilize the vertical upward motion of the microcell to produce outwardly directed movement of the antennas to a deployed position. In the deployed position, the spacing between the antennas is greater than the distance between adjacent stanchions of the tower structure. The deploying motion is accomplished without additional driving motors, but is instead produced by the upward movement of the microcell driven by a winch and cable arrangement.

37 Claims, 22 Drawing Sheets

ANTENNA DEPLOYER FOR RAISED MICROCELLS

BACKGROUND OF THE INVENTION

1. Field of the Invention

The present invention is directed to a device for deploying an antenna from a stowed position to an open deployed position. More particularly, the present invention is directed to deploying mechanisms for deploying antennas on top of a microcell which is located at the top of a tower.

2. Description of the Background Art

Standard cell site equipment is typically installed in a small block house located adjacent to a tower on which cell site antennas are mounted. The cell site radios in the block house is connected to the cell site antennas typically through hundreds of feet of coaxial cable. This arrangement produces a loss of a significant portion of the radio energy which is dissipated through the coaxial cable.

The antennas for a cell site often include a single omnidirectional whip antenna for transmitting and receiving signals, and an additional similar omnidirectional whip antenna for receiving signals. The second receive antenna is spaced some distance from the first antenna in order to provide space diversity, which ameliorates the effects of multipath fading. Multipath fading is a phenomenon in which radio signals transmitted over a large distance are received directly from the source as well as indirectly from reflected surfaces such as buildings, hills, lakes, etc. The multiple signals can combine in such a way that at certain times, the signals cancel each other, so that a highly attenuated signal is received. Spacing two receive antennas several wavelengths apart diminishes the signal fading.

SUMMARY OF THE INVENTION

The present invention is directed to a system for deploying an antenna from a stowed position to a deployed position on a tower frame having a lower section and an upper section. A carrier supporting the antenna is moveable relative to the tower frame in a direction toward the upper section, and the antenna is deployed from the stowed position to the deployed position when the carrier reaches the upper section of the tower frame.

For example, an antenna deploying mechanism moves the antennas from a stowed position within the confines of the tower structure while a microcell carrying the antennas is being raised or lowered, to a deployed position outside of the confines of the tower structure when the microcell reaches the top of the tower. The deployment can be accomplished without additional motors to move the antennas into position. Instead, the deployment mechanism can use the upward motion of the microcell provided by a winch to move the antennas from the stowed position to the deployed position. Similarly, lowering of the microcell by the winch can cause the antennas to automatically move from the deployed position to the stowed position within the confines of the tower structure.

BRIEF DESCRIPTION OF THE DRAWINGS

Other aspects and advantages of the present invention may become apparent upon reading the following detailed description and upon reference to the drawings, in which.

DETAILED DESCRIPTION

Figure 1:
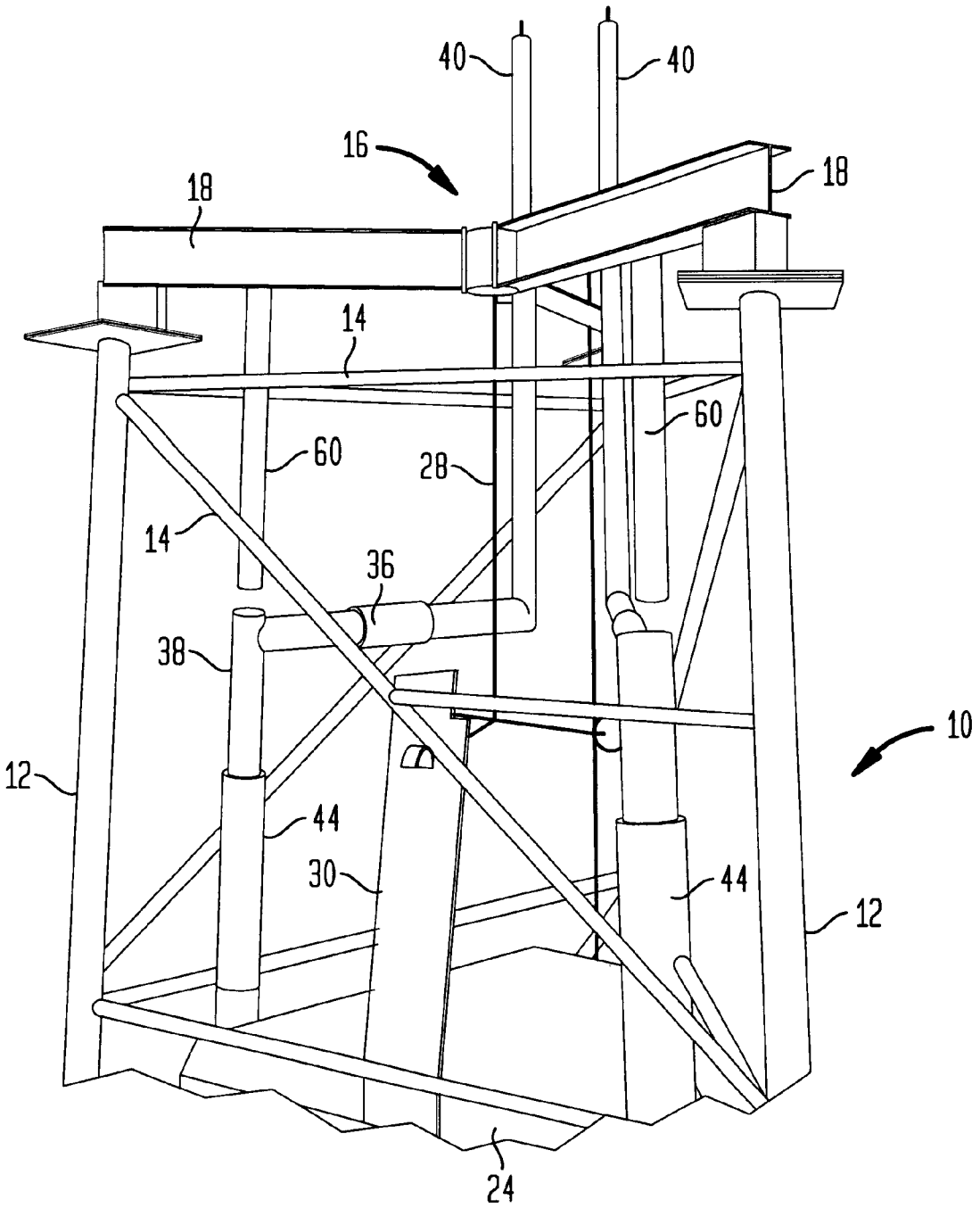
FIG. 1 is a perspective view showing a first embodiment of the antenna deployer of the present invention in a stowed position.
Figure 2:
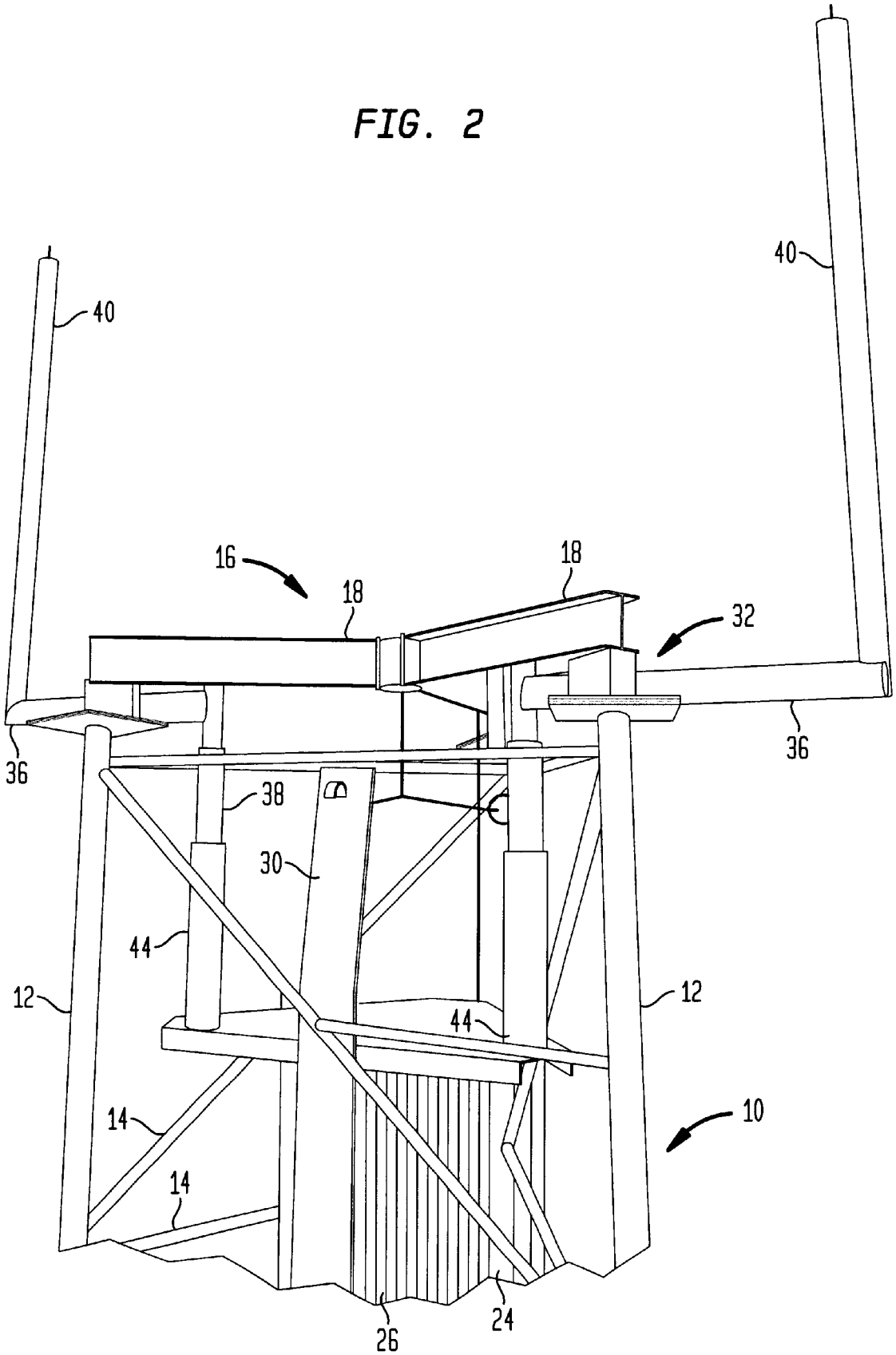
FIG. 2 is a perspective view showing the first embodiment of the antenna deployer in a deployed position.
Figure 3:
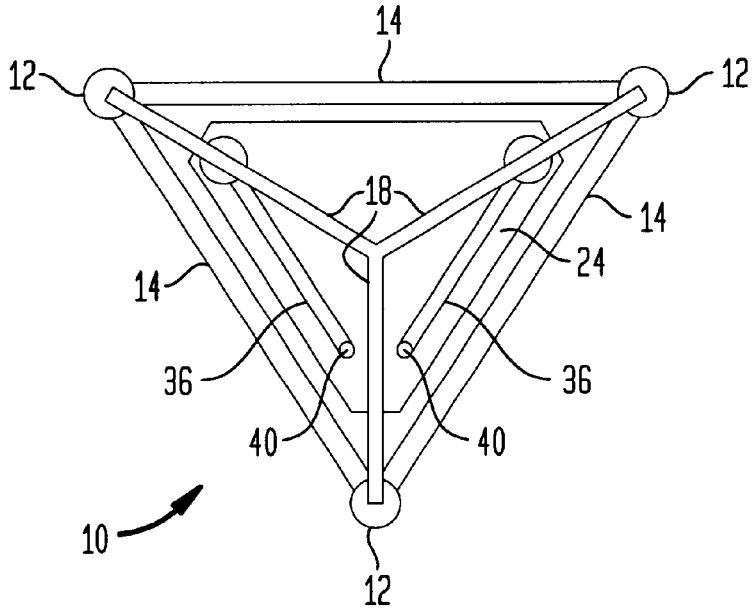
FIG. 3 is a top schematic view of the first embodiment of the antenna deployer in a stowed position.
Figure 4:
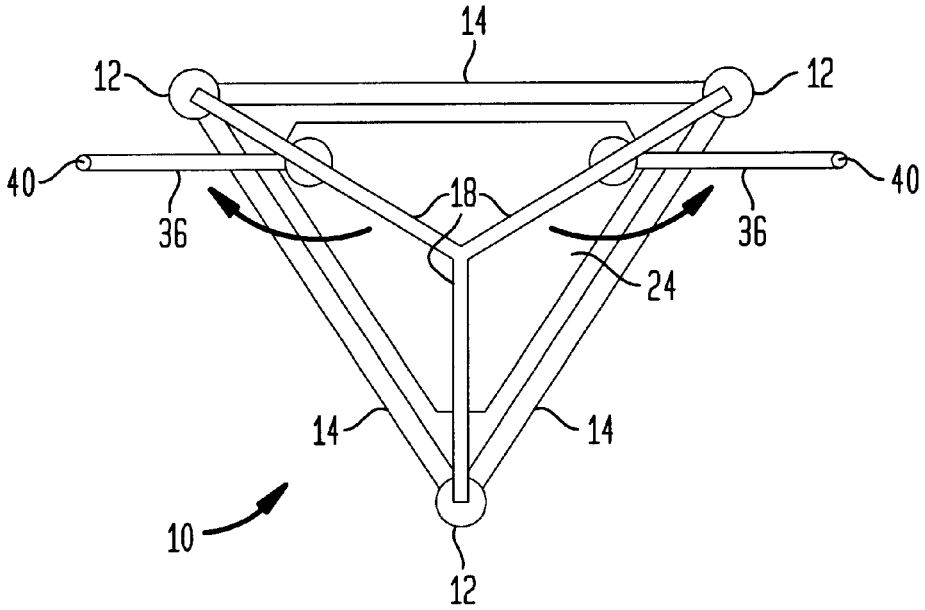
FIG. 4 is a top schematic view of the first embodiment of the antenna deployer in a deployed position.
Figure 6:
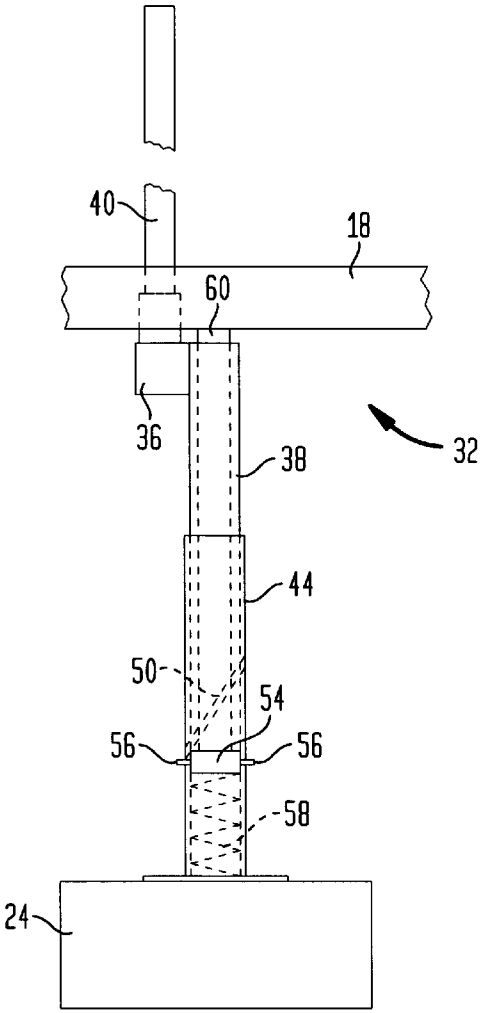
FIG. 6 is a side schematic view of the first embodiment of the antenna deployer in the deployed position.
Figure 5:
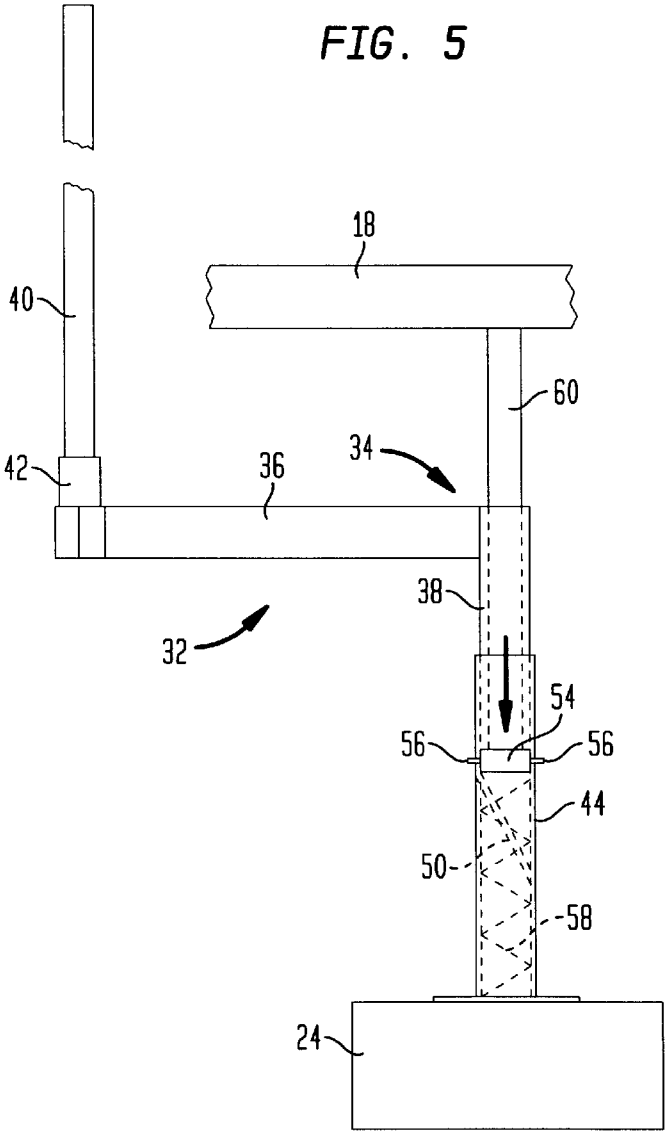
FIG. 5 is a side schematic view of the first embodiment of the antenna deployer in a stowed position.
Figure 8:
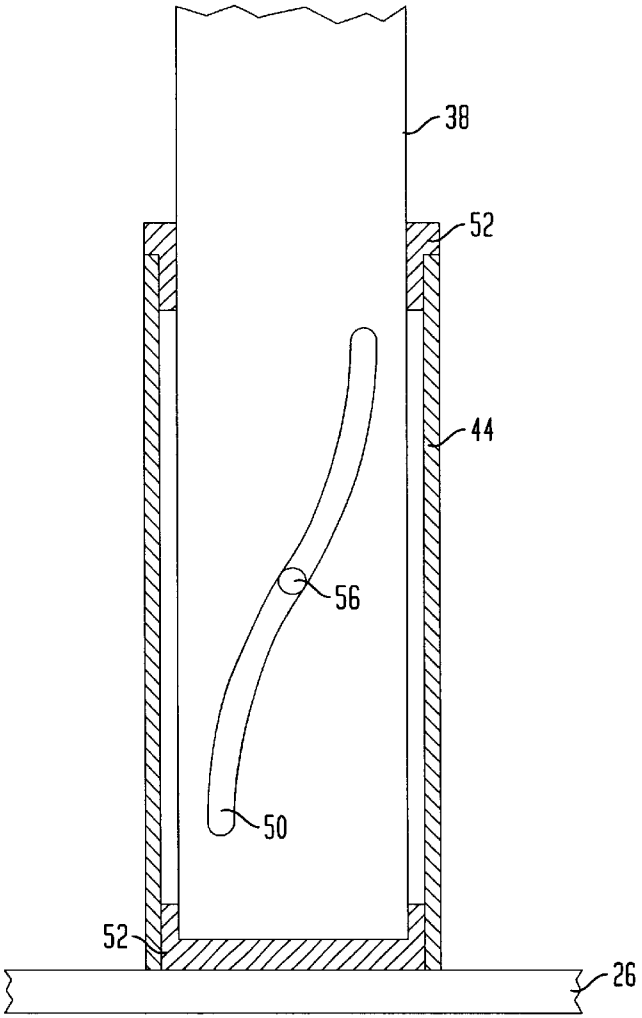
FIG. 8 is a partial cross-sectional view showing the details of the deployer arm of the first embodiment.
Figure 7:
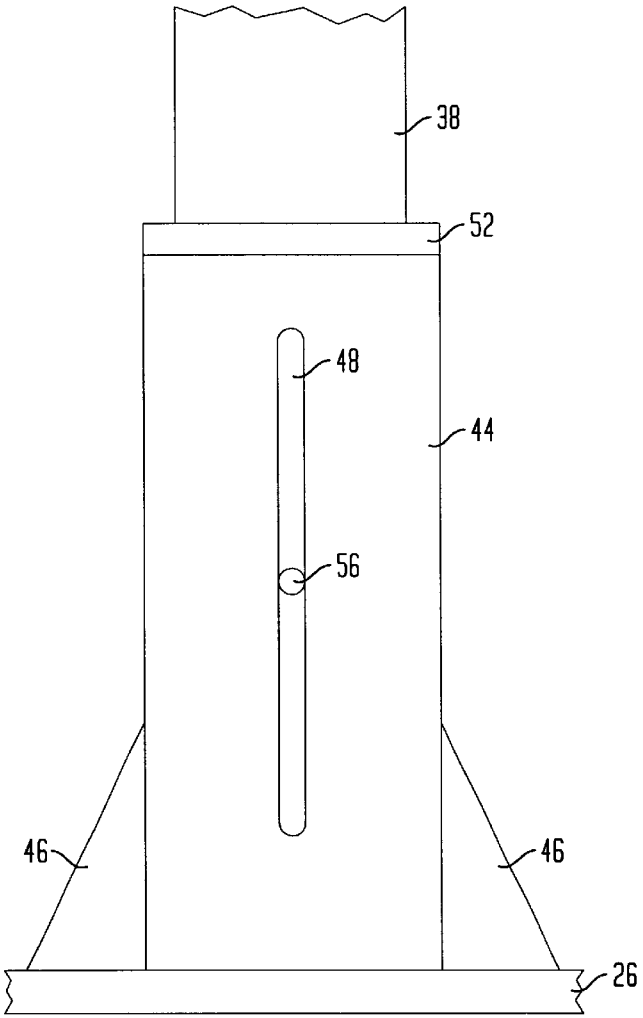
FIG. 7 is a partial side view showing the details of the deployer socket of the first embodiment.
Figure 10:
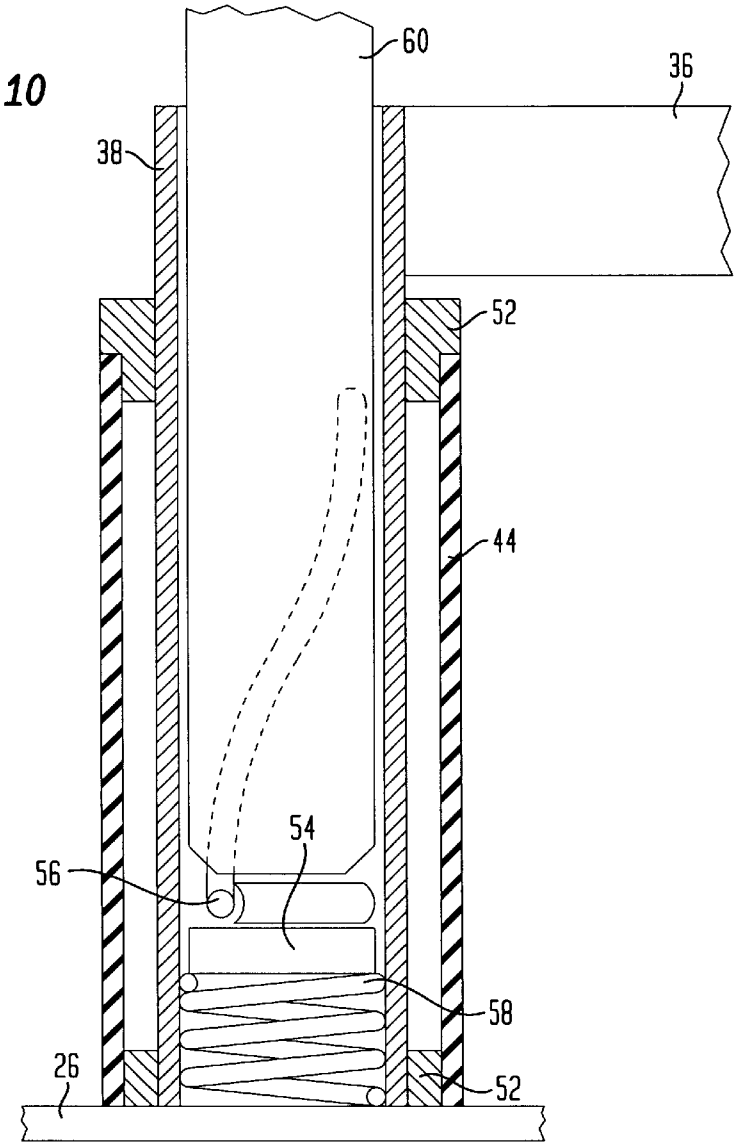
FIG. 10 is a partial cross-sectional view showing the deployer arm components of the first embodiment in a deployed position.
Figure 9:
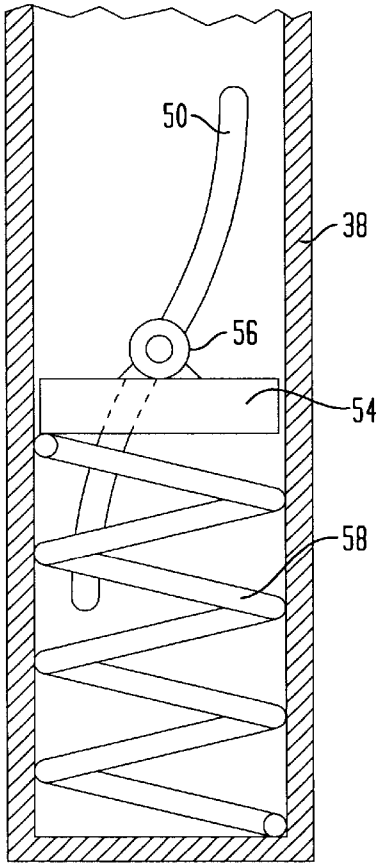
FIG. 9 is a partial cross-sectional view showing the internal components of the deployer arm of the first embodiment.
Figure 11:
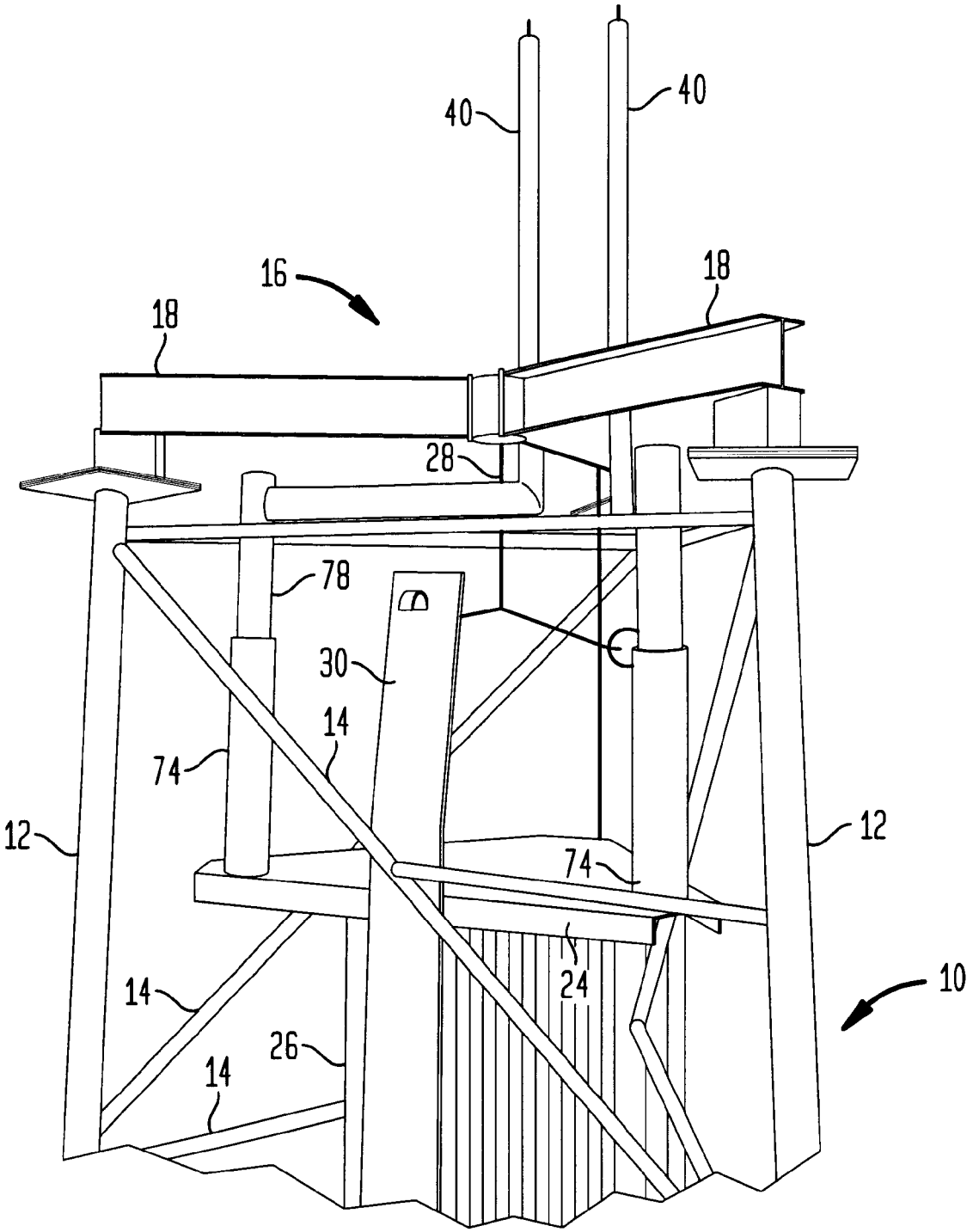
FIG. 11 is a perspective view showing a second embodiment of the present invention in a stowed position.
Figure 12:
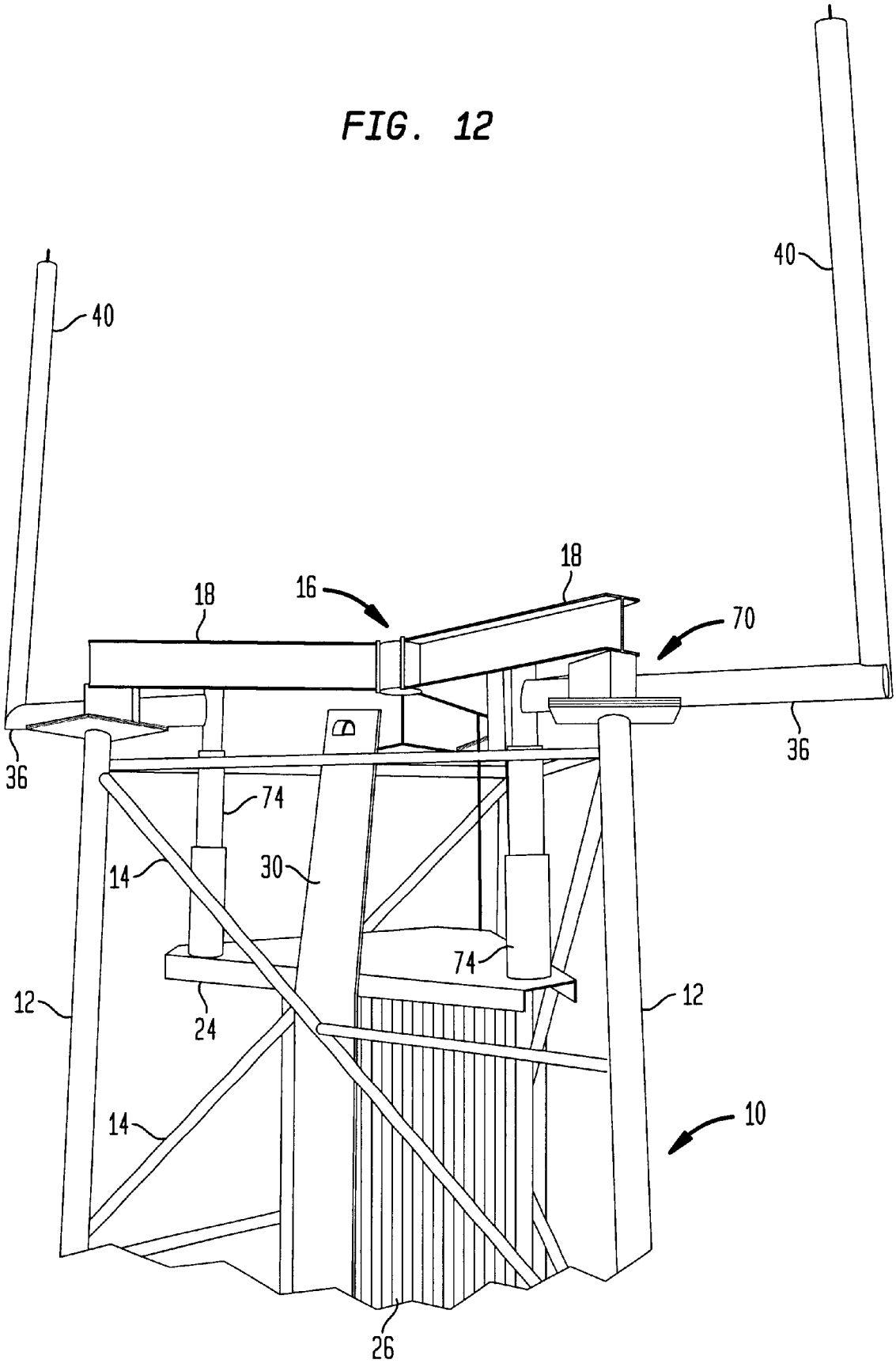
FIG. 12 is a perspective view of the second embodiment in a deployed position.
Figure 14:
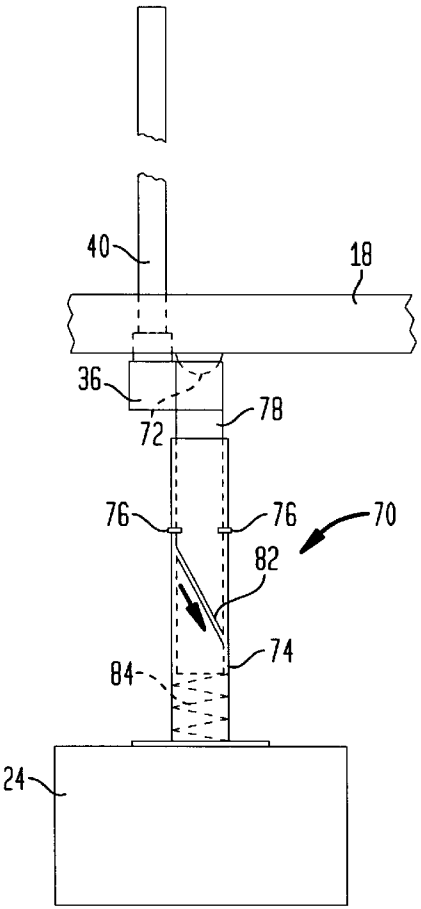
FIG. 14 is a side schematic view of the antenna deployer of the second embodiment in a deployed position.
Figure 13:
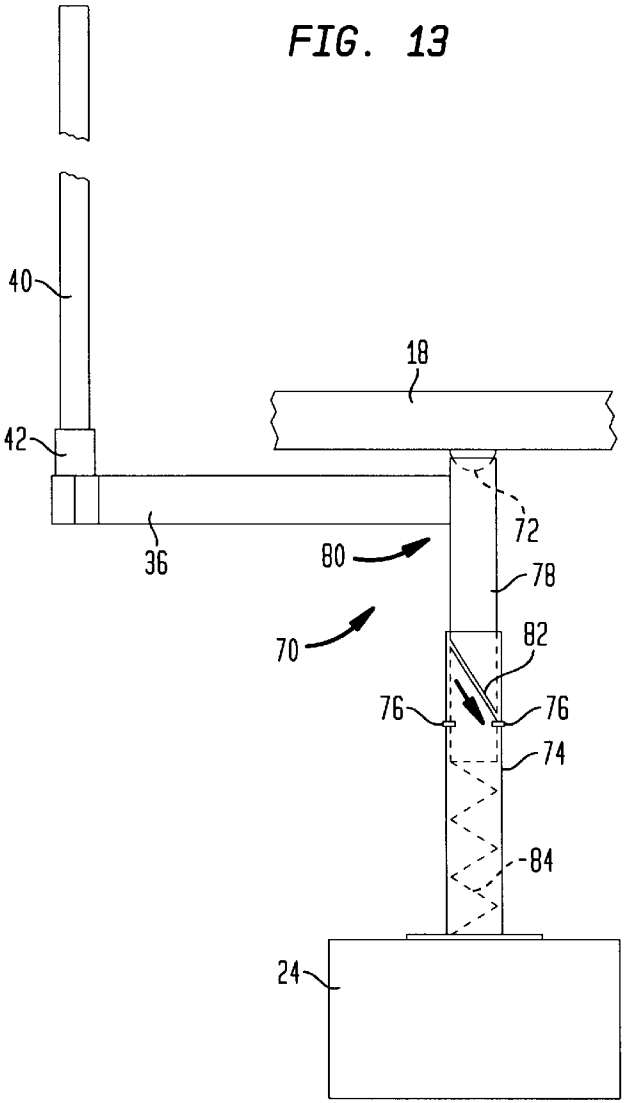
FIG. 13 is a side schematic view of the antenna deployer of the second embodiment in a stowed position.
Figure 15:
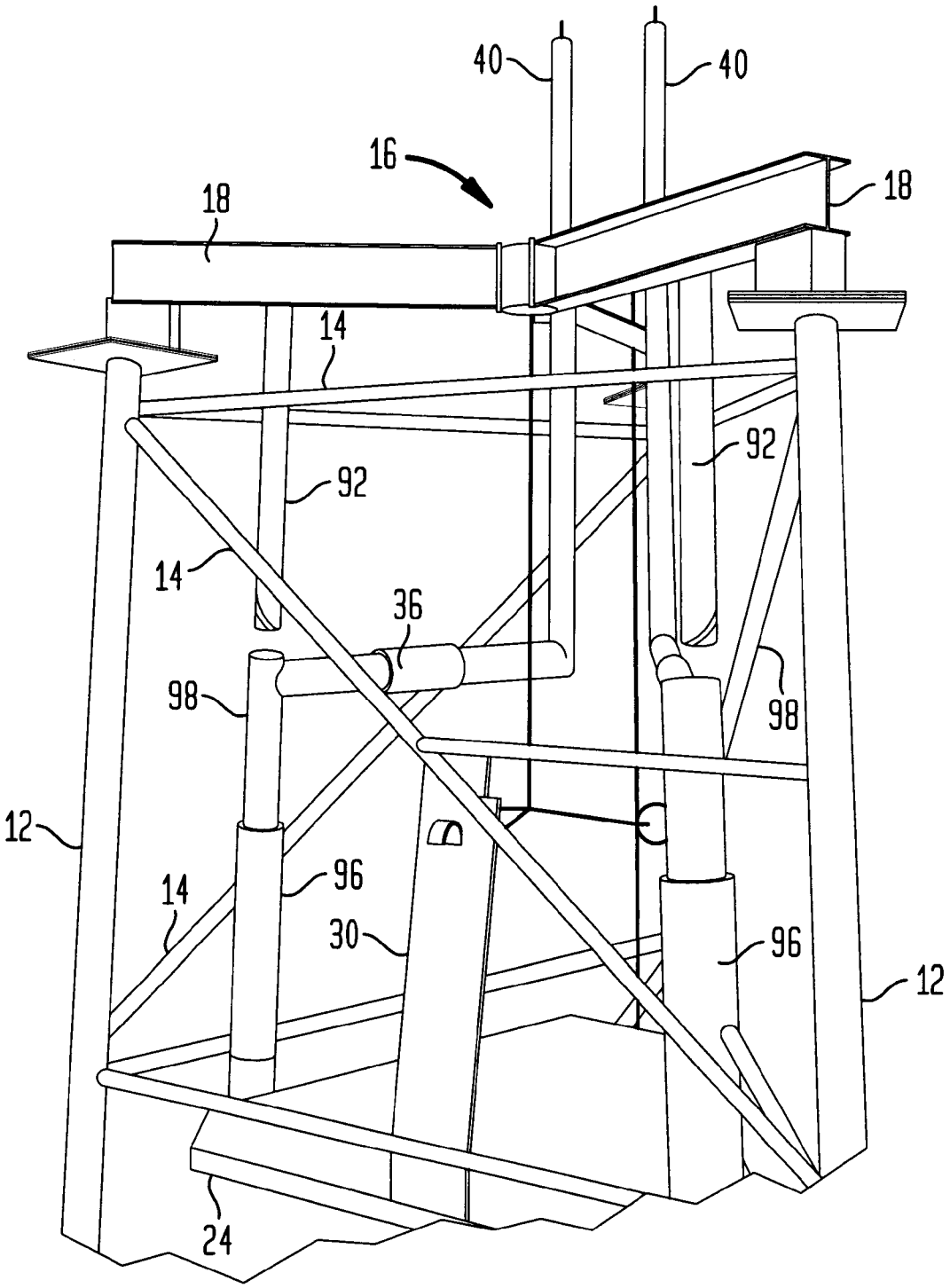
FIG. 15 is a perspective view showing a third embodiment of the present invention in a stowed position.
Figure 16:
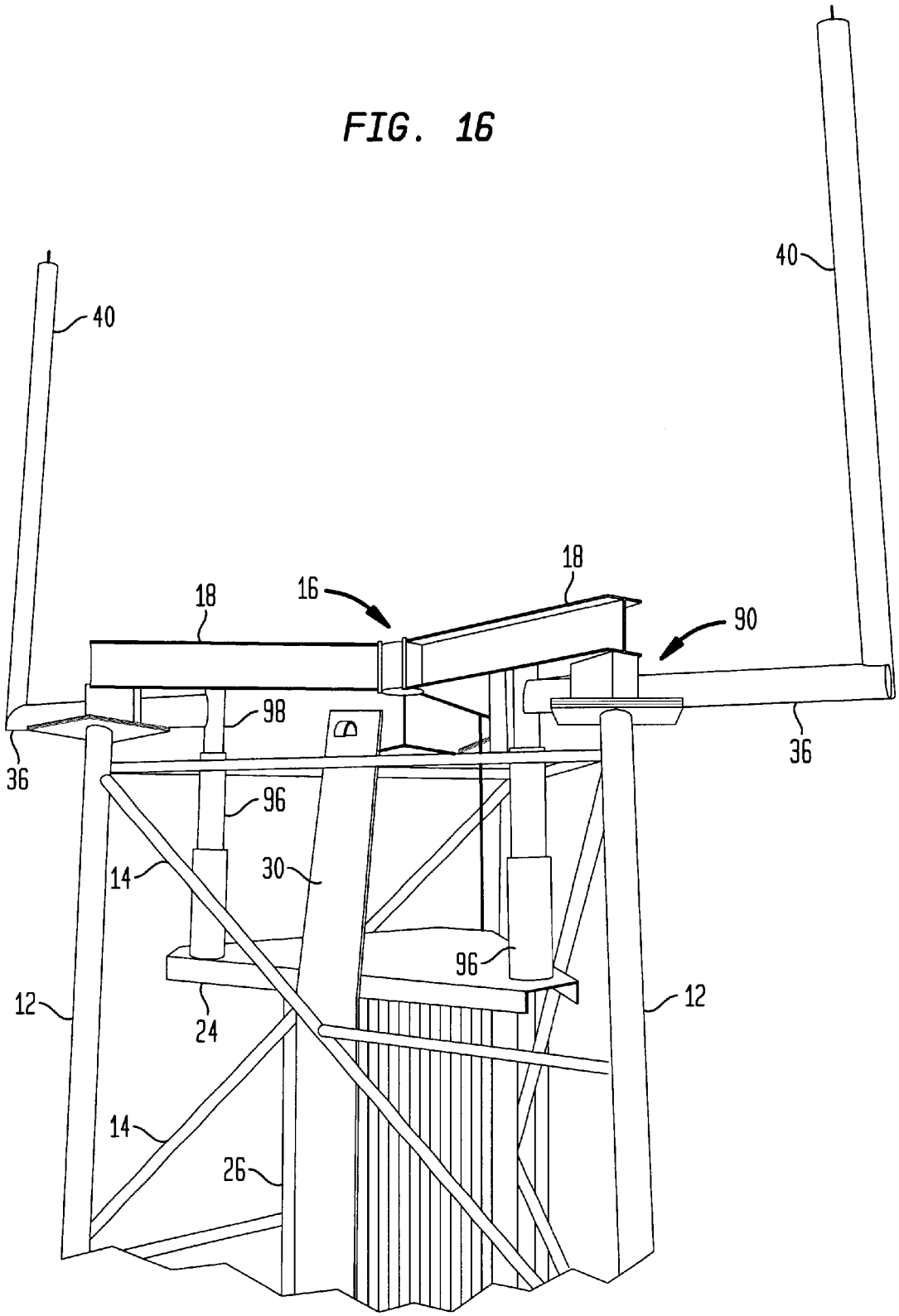
FIG. 16 is a perspective view of the third embodiment in a deployed position.
Figure 18:
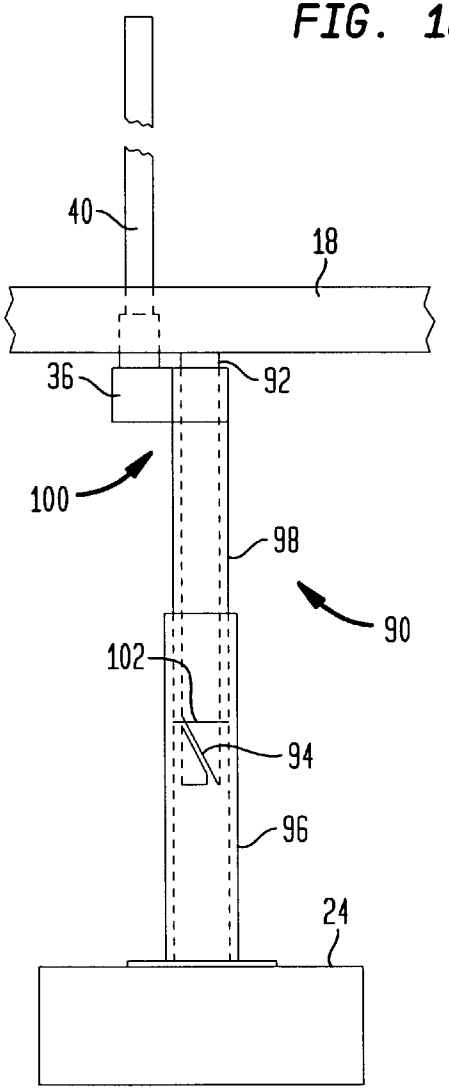
FIG. 18 is a side schematic view of the antenna deployer of the third embodiment in a deployed position.
Figure 17:
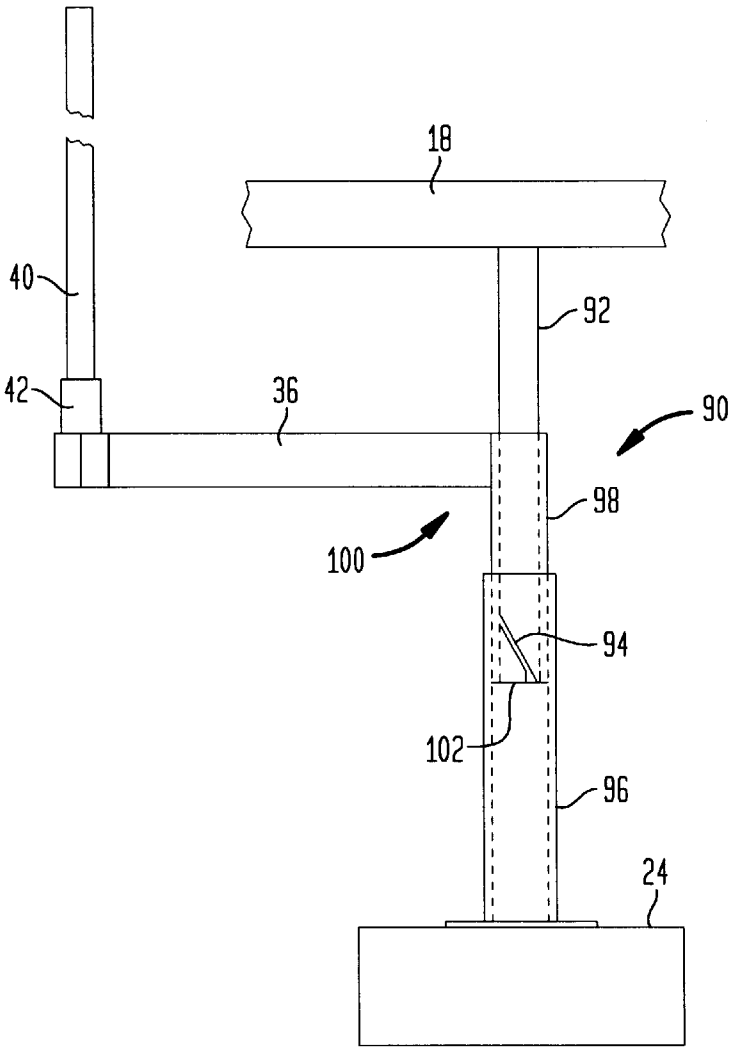
FIG. 17 is a side schematic view of the antenna deployer of the third embodiment in a stowed position.

Various embodiments of the present invention will now be described in detail, with particular reference to the drawings. Throughout the drawings, like reference numerals are utilized to identify the same or similar elements.

As shown in FIGS. 1–4, a tower 10 includes three vertical stanchions 12 arranged at apexes of an equilateral triangle. The stanchions 12 are interconnected by a plurality of lattice members 14 which are arranged both diagonally and horizontally between adjacent stanchions 12. The spacing between centers of the stanchions 12 is approximately 44 inches, although other sizes of towers 10 may be utilized with the present invention. One tower design that is particularly suitable for this arrangement is a guyed latticework structure, although other tower designs may be utilized. Further, a latticework style tower is considerably less expensive than a monopole of the same height.

Figure 31:
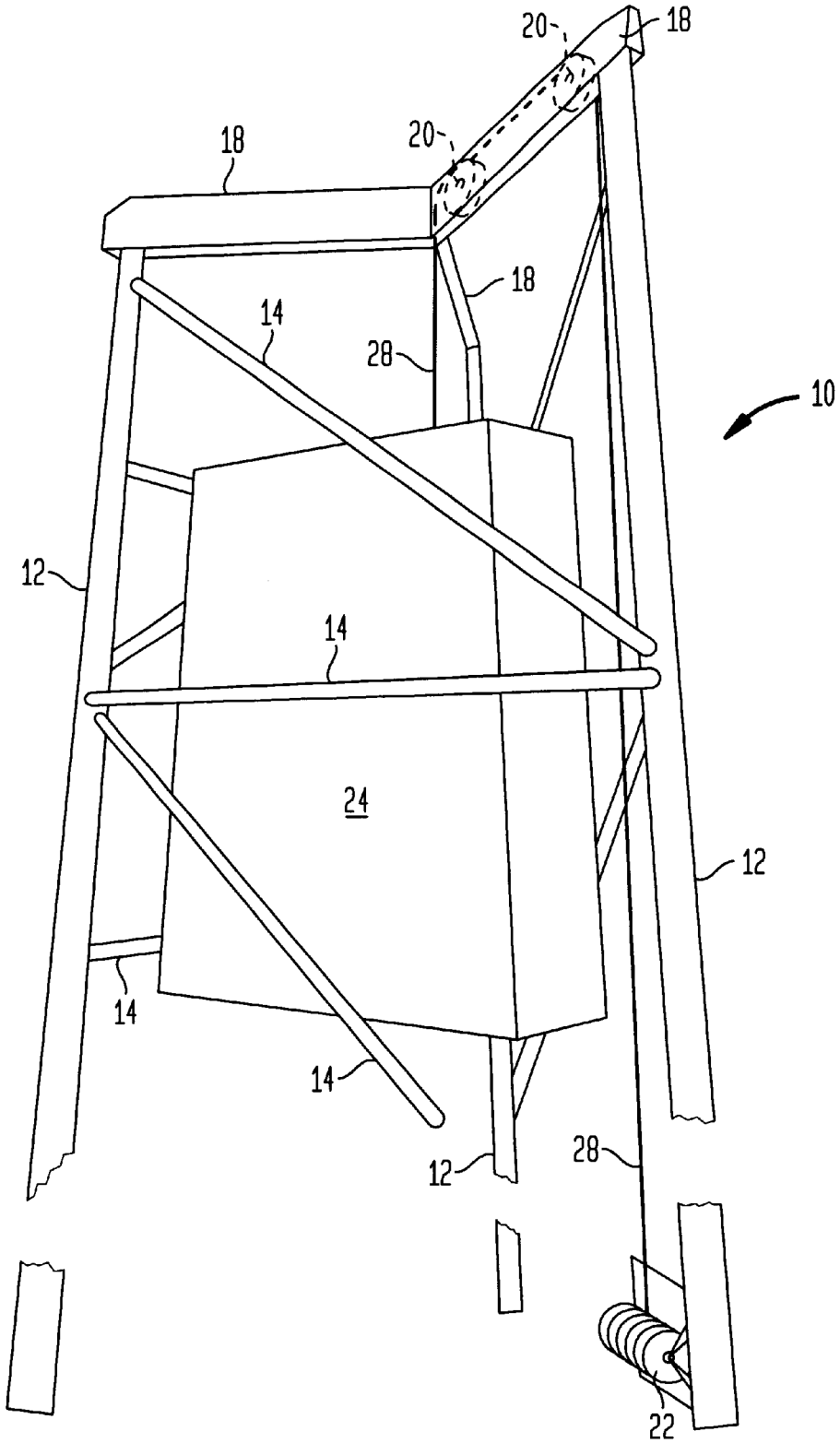
FIG. 31 is a perspective view of a tower showing the microcell elevating mechanism.

A tower cross support 16 is located at the top of the tower 10. The tower cross support 16 includes three equiangularly-spaced cross support members 18 which extend from the center of the triangle formed by the stanchions 12 to the apex of the triangle where the stanchions 12 are located. One of the cross support members 18 may include a pulley arrangement including a pair of pulleys 20 which are utilized with a winch 22, discussed in more detail below, and illustrated in FIG. 31.

A microcell 24 including cellular telephone equipment inside of a housing 26 is arranged interiorly of the tower for movement therealong. In order to reduce the loss of radio energy due to dissipation through hundreds of feet of coaxial cable, the microcell 24 is located at the top of the tower 10 with antennas 40. In this way, only several feet of coaxial cable are needed between the antennas 40 and the microcell 24, thereby significantly decreasing the loss of radio energy between the antennas 40 and the microcell radios. The antennas 40 are mounted to the microcell 24, and therefore need to be raised and lowered with the microcell 24. However, the separation distance between the antennas 40 which is required for satisfactory system performance can exceed the available space within the confines of the tower 10.

The microcell 24 is raised and lowered by a cable 28 extending from the winch 22, over the pulleys 20, and which is connected to upper ends of sled-like runners 30 fixed to the microcell 24. When maintenance is required, the microcell 24 is lowered by the winch 22. The sled-like runners 30 assist the microcell 24 in moving up and down the tower 10 in a stable manner. The microcell 24 acts as a carrier for the components forming an antenna deployer 32. The advantage of putting the microcell 24 within the tower 10 is that the tower structure is used to guide the microcell 24 as it is being raised and lowered. Additionally, the tower 10 provides a level of safety in the event that the microcell 24 becomes detached from the winch cable 28.

Referring now to FIGS. 5–10, the antenna deployer 32 includes a deployer arm 34 including a horizontal arm member 36 and a vertical arm member 38. An antenna 40 is attached to the distal end of the horizontal arm member 36 of the deployer arm 34 by a suitable connection, such as a threaded connection. The distal end of the horizontal arm member 36 includes a second auxiliary vertical arm member 42 which supports the lower end of the antenna 40 therein or thereon. The vertical arm members 38, 42 and horizontal arm member 36 of the deployer arm 34 may be made of round aluminum tubing, such as 6061-T6 aluminum to support the size of antennas typically used in this application. The tubing may have has a 2½ inch diameter and a 0.065 inch wall thickness. Of course, other materials and sizes may be utilized with the present invention.

A deployer socket 44 is fixedly attached to the upper end of the microcell 24. The deployer socket 44 receives the vertical arm member 38 of the deployer arm 34 therein. The deployer socket 44 and the vertical arm member 38 are cylindrical, tubular members coaxially aligned one within the other. The deployer socket 44 may include a plurality of gussets 46 for vertically stabilzing the deployer socket 44 with respect to the microcell 24. The deployer socket 44 includes a vertically oriented is rectilinear guide slot 48 therein. A second identical vertically oriented rectilinear guide slot 48 is located on an opposite side of the deployer socket 44, although the invention may be utilized with a single vertically oriented rectilinear guide slot 48 in the deployer socket 44. The vertical arm member 38 of the deployer arm 34 includes a helical guide slot 50 therein, and contains a second helical guide slot 50 located opposite thereto, although the invention may be practiced with a single helical guide slot 50.

The deployer socket 44 includes a pair of spaced-apart bushings 52 at upper and lower ends thereof for rotatably guiding the deployer arm 34 with respect to the deployer socket 44. The pair of bushings 52 located between the deployer arm 34 and the deployer socket 44 may be made from a self-lubricating plastic such as celcon to provide a low-friction bearing surface. However, other types of bushings 52 may be utilized, or bearings may be utilized such as roller or ball bearings if desired.

Located interiorly of the vertical arm member 38 of the deployer arm 34 is an actuating disc 54 having a rotator pin 56 fixed thereto. With the vertical arm member 38 located within the deployer socket 44, the rotator pin 56 is arranged to penetrate through the helical guide slot 50 of the deployer arm 34 and the rectilinear guide slot 48 of the deployer socket 44. In this embodiment, since a pair of rectilinear guide slots 48 and a pair of helical guide slots 50 are provided, the rotator pin 56 extends through both sets of rectilinear guide slots 48 and helical guide slots 50.

A compression spring 58 is arranged between the actuating disc 54 and the end of the vertical arm member 38 of the deployer arm 34. The compression spring 58 is configured to bias the actuating disc 54 and rotator pin 56 to an uppermost position within the helical guide slot 50 and the rectilinear guide slot 48. When the actuating disc 54 is in this uppermost position, the deployer arm 38 and the antenna 40 are in the stowed position.

Referring now to FIGS. 1, 2, 5 and 6, it can be seen that two of the cross support members 18 include a downwardly-depending rod 60 which serves to activate the antenna deployer 32 in this first embodiment. As the microcell 24 is raised by the winch 22 and cable 28, a point is reached wherein the distal end of the rod 60 depending from the tower cross support member 18 engages and penetrates into the hollow interior of the vertical arm member 38 of the deployer arm 34. As the microcell 24 is further raised, the distal end of the rod 60 engages the upper surface of the actuating disc 54. With further upward movement of the microcell 24, the rod 60 pushes the actuating disc 54 downwardly against the biasing force provided by the compression spring 58. This in turn causes the rotator pin 56 to move along the helical guide slot 50 and the rectilinear guide slot 48. Because the deployer socket 44 is fixed with respect to the microcell 24, and thus the position of the rectilinear guide slot 48 does not change, the orientation of the rotator pin 56 with respect to the rectilinear guide slot 48 does not change. However, because the rotator pin 56 is also guided by the helical guide slot 50, it is necessary for the deployer arm 34, and thus the helical guide slot 50, to rotate as the actuating disc 54 is moved downwardly. Accordingly, as the deployer arm 34 rotates, the horizontal arm member 36 of the deployer arm 34 moves from the stowed position within the confines of the triangle formed by the stanchions 12, to the deployed position shown in FIGS. 2 and 4 wherein the antenna 40 is spaced outwardly of the tower 10. When two antennas 40 are in the deployed position, the spacing between the antennas 40 is approximately six feet, although other spacings may be utilized with the present invention.

When the microcell 24 is lowered, the process is reversed. The biasing force provided by the compression spring 58 forces the actuating disc 54 upwardly, thereby forcing the rotator pin 56 to move within the helical guide slot 50 to rotate the horizontal arm member 36 of the deployer arm 34 back to the stowed position. When the microcell 24 is in the filly elevated position, and the antenna 40 is in the deployed position, the microcell 24 is simply held in place by the supporting cable 28 connected to the winch 22. Thus, it can be seen that the present invention provides a simple and efficient mechanism for deploying an antenna 40 without the use of any additional driving motors, and instead, the deployment and undeployment motions of the antenna 40 are controlled by the raising and lowering of the microcell 24.

An antenna cable interconnecting the antenna 40 to the microcell 24 may pass through the tubing forming the horizontal arm member 36 and the vertical arm member 38. Accordingly, a continuous passage is provided between the lower end of the vertical arm member 38 to the outer end of the horizontal arm member 36. Further, when the deployer arm 34 is used with the auxiliary vertical arm member 42 located at the distal end of the horizontal arm member 38, the continuous passage extends through the junction between the horizontal member 36 and both of the vertical arm members 38, 42 so that the antenna cable may pass completely through the deployer arm 34 from one end to another. The antenna cable may exit the vertical arm member 38 through an aperture provided in a sidewall thereof at a location above where the uppermost portion of the deployer socket 44 would reach so that the deployer socket 44 would not interfere with the antenna cable. Alternatively, it is envisioned that an arrangement may be provided wherein the antenna cable passes completely through the bottom of the vertical arm member 38, through an aperture provided centrally within the actuating disc 54, and extends through the center of the compression spring 58 and the deployer socket 44 and into the microcell 24.

An antenna deployer 70 according to a second embodiment of the present invention will now be described, with particular reference to FIGS. 11–14. In the second embodiment, the cross support members 18 of the tower do not have a rod 60 extending downwardly therefrom. Instead, the cross support members 18 include a knob or protrusion 72 on a lower side thereof although alternatively the lower side may simply be flat. However, the protrusion 72 on the cross support member 18 tends to locate the antenna deployer 70 into position prior to rotating into the deployed position. In the second embodiment, the deployer socket 74 does not include the rectilinear guide slot 48 as in the first embodiment. Instead, a pin 76 is fixed in position to the deployer socket 74. A vertical arm member 78 of the deployer arm 80 includes a helical guide slot 82 which receives the pin 76 therein.

A compression spring 84 is located within the deployer socket 74 and is compressed between the end of the vertical arm member 78 of the deployer arm 80 and the base of the deployer socket 74. As the microcell 24 is raised, a point is reached where the upper end of the vertical arm member 78 engages the protrusion 72 on the cross support member 18. Further raising of the microcell 24 having the deployer socket 74 fixed thereto causes the pin 76 to move along the helical guide slot 82 in the vertical arm member 78 of the deployer arm 80.

Because the position of the deployer socket 74 is fixed, and the position of the pin 76 is fixed, the vertical arm member 78 must rotate as the deployer socket 74 is raised because of the engagement of the pin 76 within the helical guide slot 82. Therefore, the raising of the microcell 24 causes the deployer arm 80 to rotate from the stowed position shown in FIG. 11 to the deployed position shown in FIG. 12.

When the microcell 24 is lowered, the compression spring 84 forces the vertical arm member 78 of the deployer arm 80 upwardly in a direction away from the microcell 24, causing the deployer arm 80 to move the antenna 40 into the stowed position because of the interaction of the helical guide slot 94 following the constraint provided by the pin 76. In this embodiment, a pair of spaced-apart pins 76, or one double-ended pin 76, extending into both sides of the deployer socket 74, is utilized and which follows a pair of opposed helical slots 82. However, it should be understood that a single pin 76 and a single helical guide slot 82 may be utilized to produce the rotational movement of the deployer arm 80 from the linear movement of the microcell 24 and deployer socket 74.

An antenna deployer 90 according to a third embodiment of the present invention will now be explained, with particular reference to FIGS. 15 through 18. In the embodiment shown in FIG. 15, the cross support members 18 include a downwardly-depending rod 92. The distal end of the downwardly-depending rod 92 includes a helical slot 94 provided in a sidewall thereof. A deployer socket 96 is fixed to the upper end of the microcell 24, and a vertical arm member 98 of a deployer arm 100 is located fully within the deployer socket 96. In this third embodiment, a spring is not required between the lower end of the vertical arm member 98 of the deployer arm 100 and the base of the deployer socket 96. A pin 102 is fixedly attached and extends across the hollow portion of the vertical arm member 98.

As the microcell 24 is raised, and consequently the antenna deployer 90 is raised, a point is reached wherein the downwardly-depending rod 92 enters into the hollow portion of the vertical arm member 98. Upon further raising of the microcell 24, the helical slot 94 in the downwardly-depending rod 92 engages the pin 102 extending across the hollow portion of the vertical arm member 98. Continued raising of the microcell 24 and the antenna deployer 90 causes the vertical arm member 98 to rotate by the action of the pin 102 sliding along the helical slot 94 in the downwardly-depending rod 92. This is because the orientation of the helical slot 94 in the downwardly-depending rod 92 is fixed with respect to the tower 10 and to the microcell 24. Thus, it is necessary for the vertical arm member 98 to rotate as the microcell 24 is further raised. This causes the horizontal arm member 36 to swing outwardly and move the antenna 40 from the stowed position shown in FIG. 15 to the deployed position shown in FIG. 16. When the microcell 24 is lowered, a reverse process occurs wherein the weight of the antenna 40 and deployer arm 100 causes them to remain within the deployer socket 96 and to rotate with respect to the downwardly-depending rod 92 by the interaction of the pin 102 following the helical slot 94 in the downwardly-depending rod 92.

An antenna deployer 110 accordingly to a fourth embodiment of the present invention will now be described, with particular reference to FIGS. 19 through 22. In the fourth embodiment, the tower cross support 16 includes a single downwardly-depending rod 112 located at the center of the tower cross support 16, which is centrally located within the triangular area formed by the three stanchions 12. The distal end of the downwardly-depending rod 112 includes a helical slot 114 as in the third embodiment.

The antenna deployer 110 of the fourth embodiment includes a central horizontal arm 116 rotatably mounted to the top of the microcell 24 and centrally thereof Each end of the central horizontal arm 116 includes a horizontal arm member 118 pivotally connected thereto. A distal end of each of the horizontal arm members 118 includes an antenna 40 extending upwardly therefrom. Located at the center of the central horizontal arm 116 is a socket 120 having a pin 122 extending across a hollow interior portion thereof.

Similarly to the actuation of the antenna deployer 90 of the third embodiment, in the fourth embodiment, as the microcell 24 is raised, the pin 122 in the socket 120 of the central horizontal am 116 becomes engaged in the helical slot 114 in the downwardly-depending rod 112 attached to the tower cross support 16. Further upward movement of the microcell 24 and the antenna deployer 110 causes the pin 122 to slide along the helical slot 114 in the downwardly-depending rod 112, thus causing the central horizontal arm 116 of the antenna deployer 110 to rotate as the pin 122 follows the helical slot 114. As the central horizontal arm 116 of the antenna deployer 110 rotates, the horizontal arm members 118 rotate therewith to a point where the horizontal arm members 118 engage deflector blocks 124 attached to the tower 10. The deflector blocks 124 cause the horizontal arm members 118 to move away from the central horizontal arm 116 through a position shown in FIG. 20, to the deployed position shown in FIG. 21. The length of the central horizontal arm 116 is sized so that it does not contact the deflector blocks 124, while the length of the horizontal arm members 118 are sized so that, upon rotation of the central horizontal arm 116, the horizontal arm members 118 engage the deflector blocks 124 to deflect the horizontal arm members 118 into the deployed position upon further rotation of the central horizontal arm 116.

Figure 19:
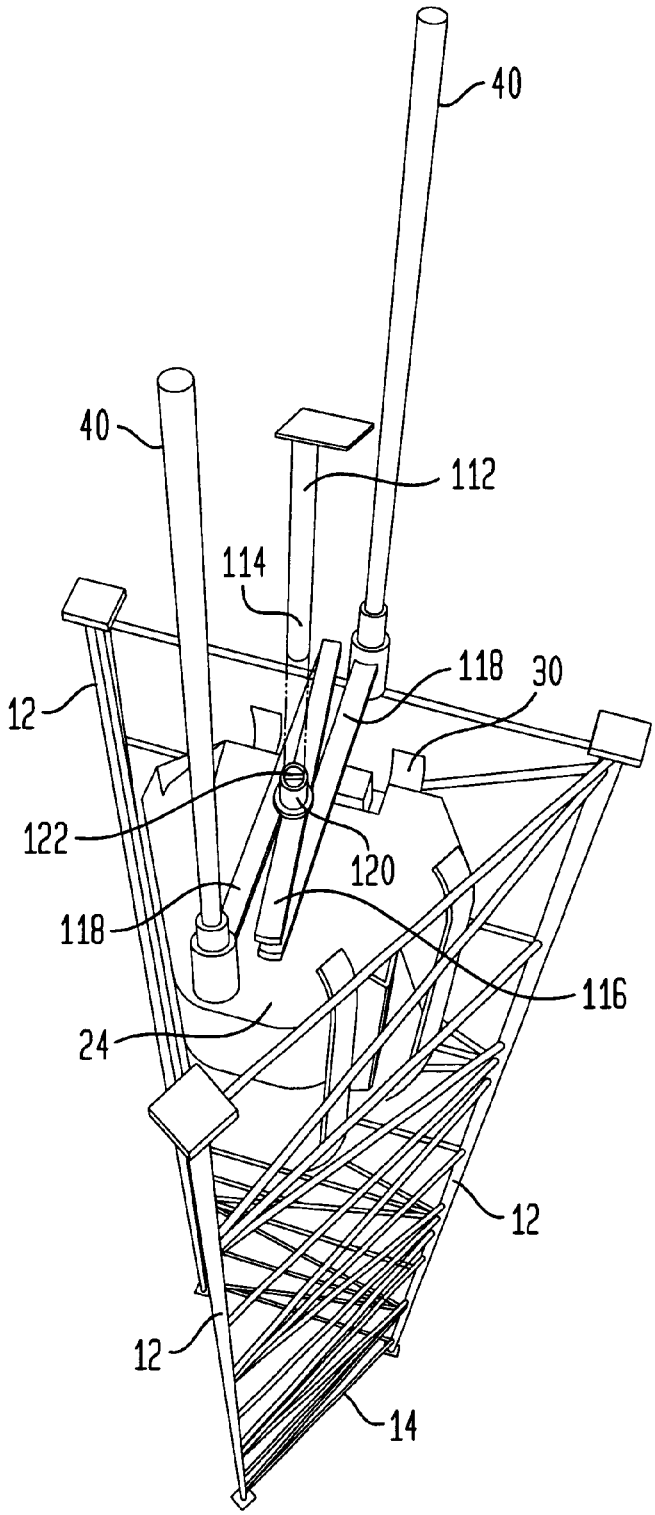
FIG. 19 is a perspective view of an antenna deployer according to a fourth embodiment of the present invention in a stowed position.
Figure 20:
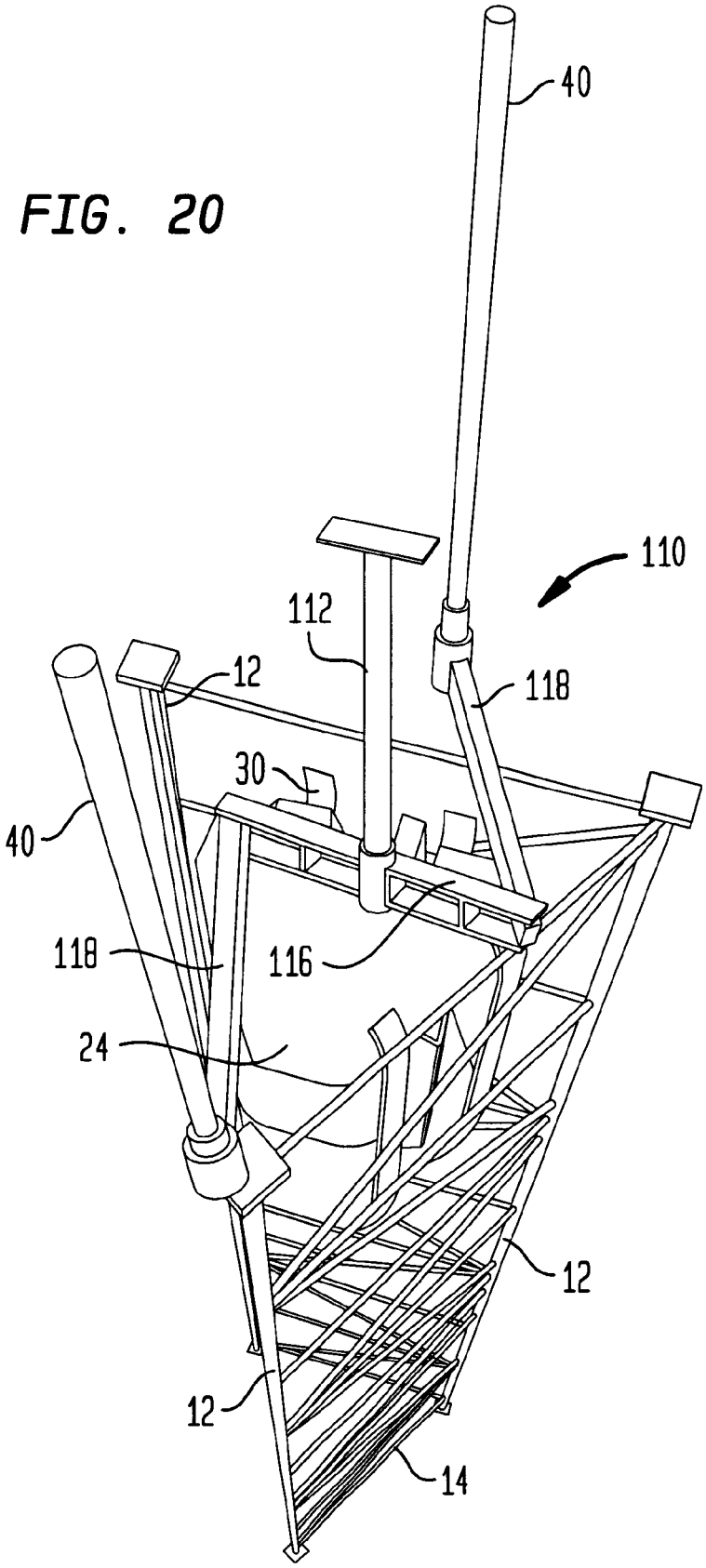
FIG. 20 is a perspective view of the antenna deployer of the fourth embodiment in a partially deployed position.
Figure 21:
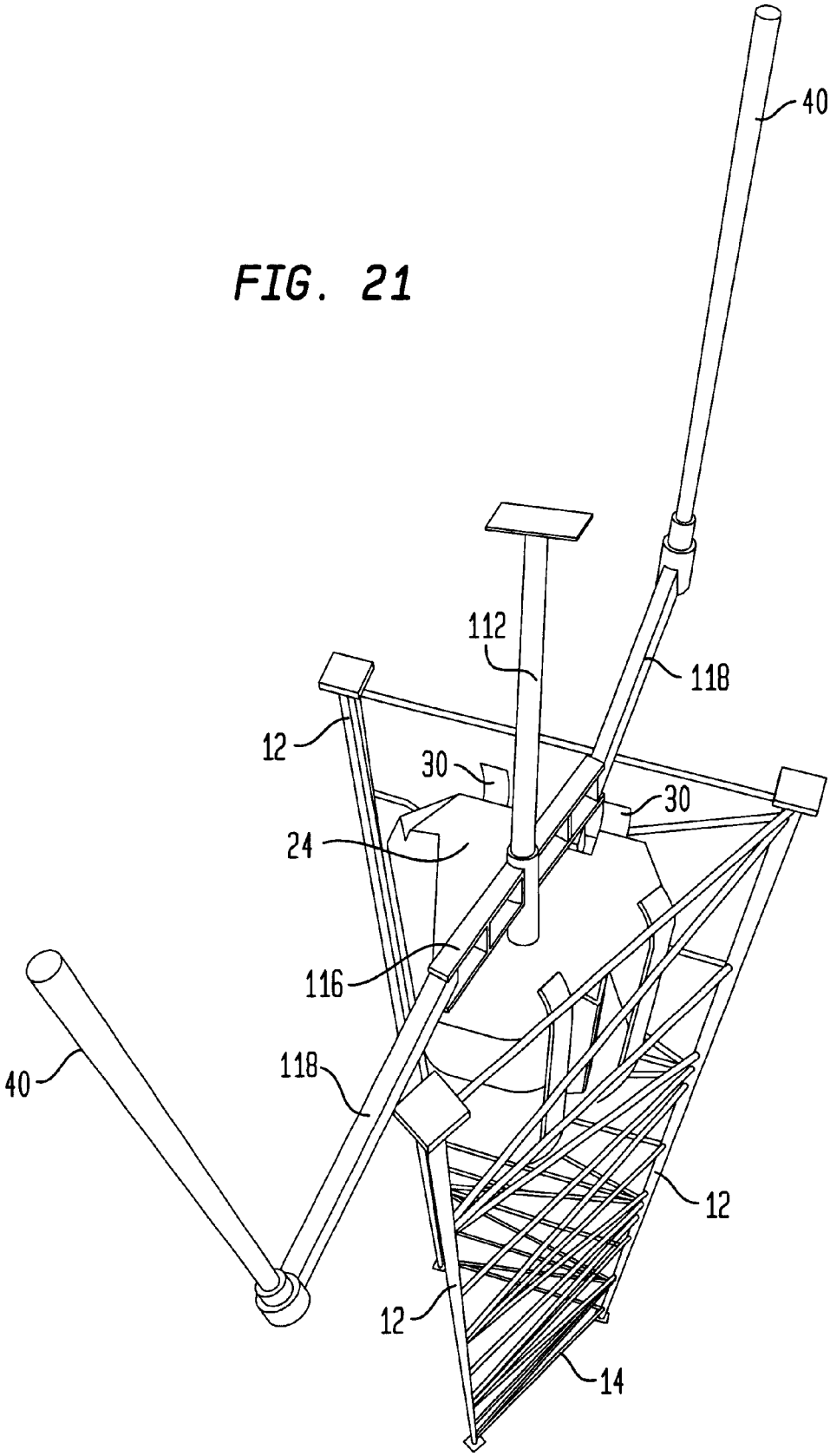
FIG. 21 is a perspective view of the antenna deployer of the fourth embodiment in a fully deployed position.
Figure 22A:
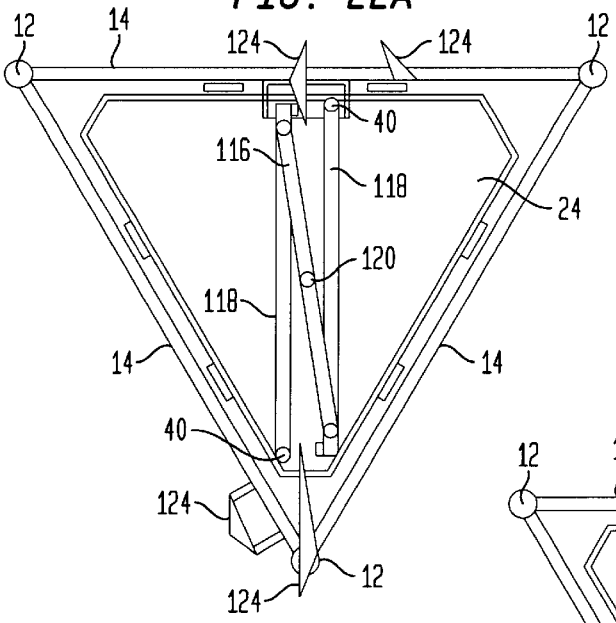
FIGS. 22*a*, 22*b* and 22*c* are top schematic views of the antenna deployer of the fourth embodiment showing the antenna deployer in the stowed position, the partially deployed position, and the fully deployed position, respectively, corresponding to FIGS. 19 through 21.
Figure 22B:
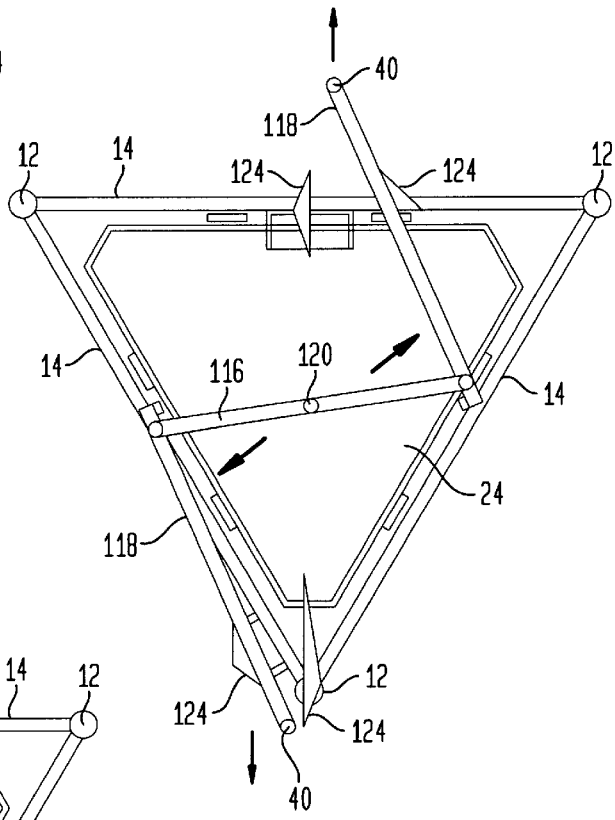
Figure 22C:
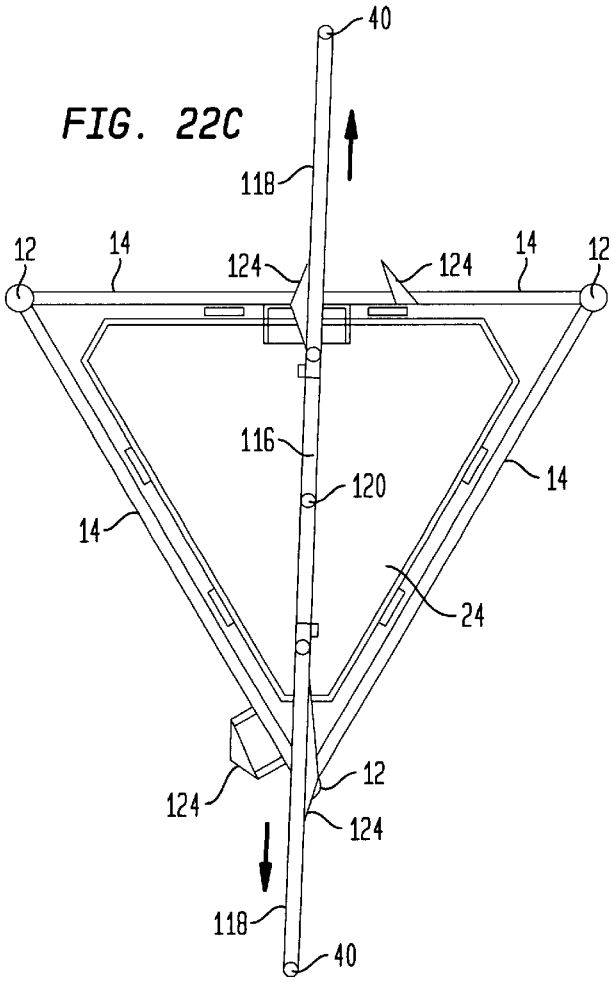

To return the antenna 40 to the stowed position, the microcell 24 is lowered, causing the central horizontal arm 116 to rotate as the pin 122 in the socket 120 follows the helical slot 114 of the fixed downwardly-depending rod 112. Additional deflector blocks 124 are utilized to assist movement of the horizontal arm members 118 to the stowed position beside the central horizontal arm 116. In FIGS. 19 through 21, the tower cross support 16 has been removed from the figures for clarity.

Figure 23:
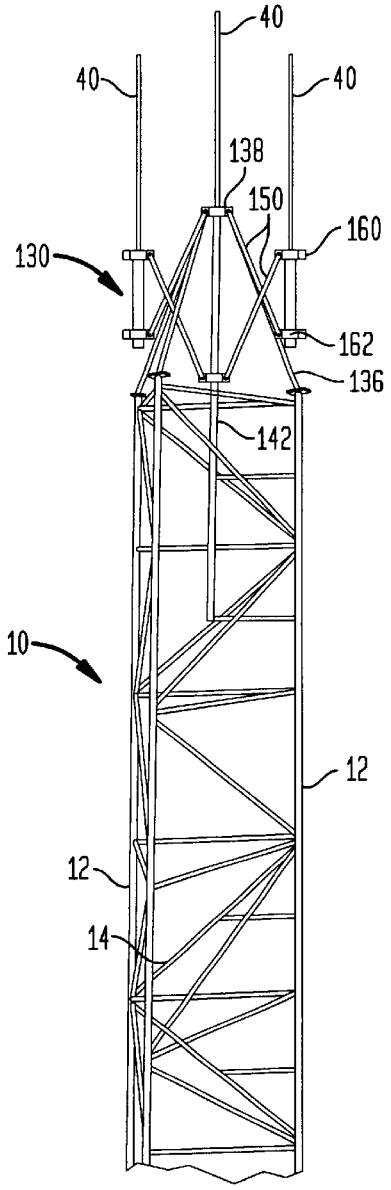
FIG. 23 is a perspective view showing a fifth embodiment of the present invention in a stowed position.
Figure 24:
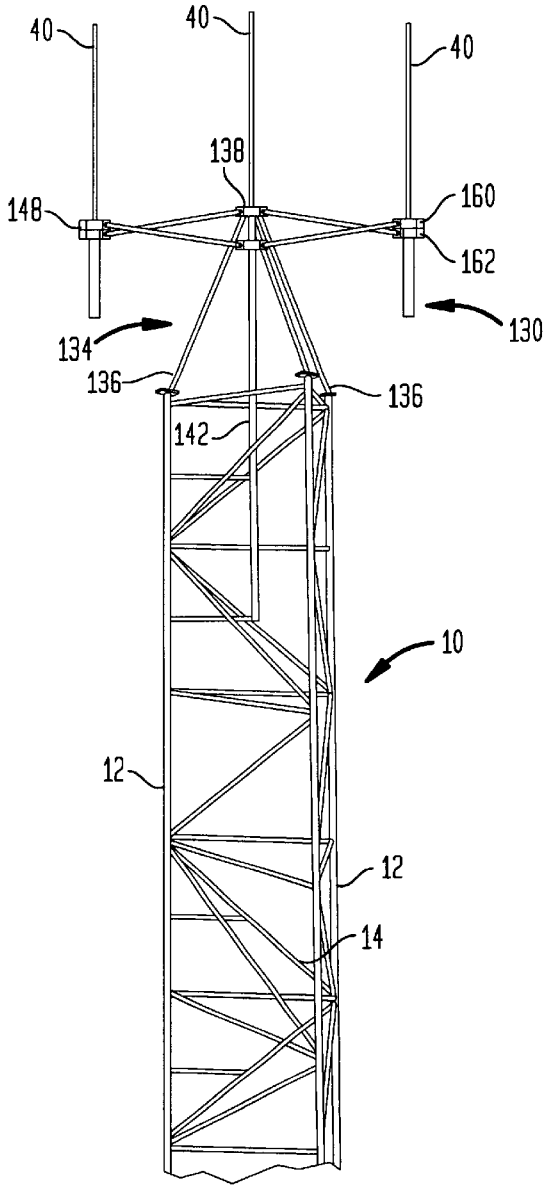
FIG. 24 is a perspective view of the fifth embodiment in a deployed position.

An antenna deployer 130 according to a fifth embodiment and an antenna is deployer 132 according to a sixth embodiment of the present invention will now be described with respect to FIGS. 23 through 26. As shown in FIGS. 23 and 24, a tower cross support 134 located across the tower 10 is not formed as a planar unit, but is instead formed by three cross support members 136 extending upwardly and inwardly from the top end of each of the stanchions 12. A ring 138 having an aperture 140 therein is located at the junction of the upper ends of each of the cross support members 136. toward the upper guide 146. During this movement, the antenna support members 148 are pushed outwardly until a point is reached where the lower guide 144 abuts the upper guide 146 and cannot move upwardly any further, and the antennas 40 are in the fully deployed position as shown in FIG. 26.

Figure 26:
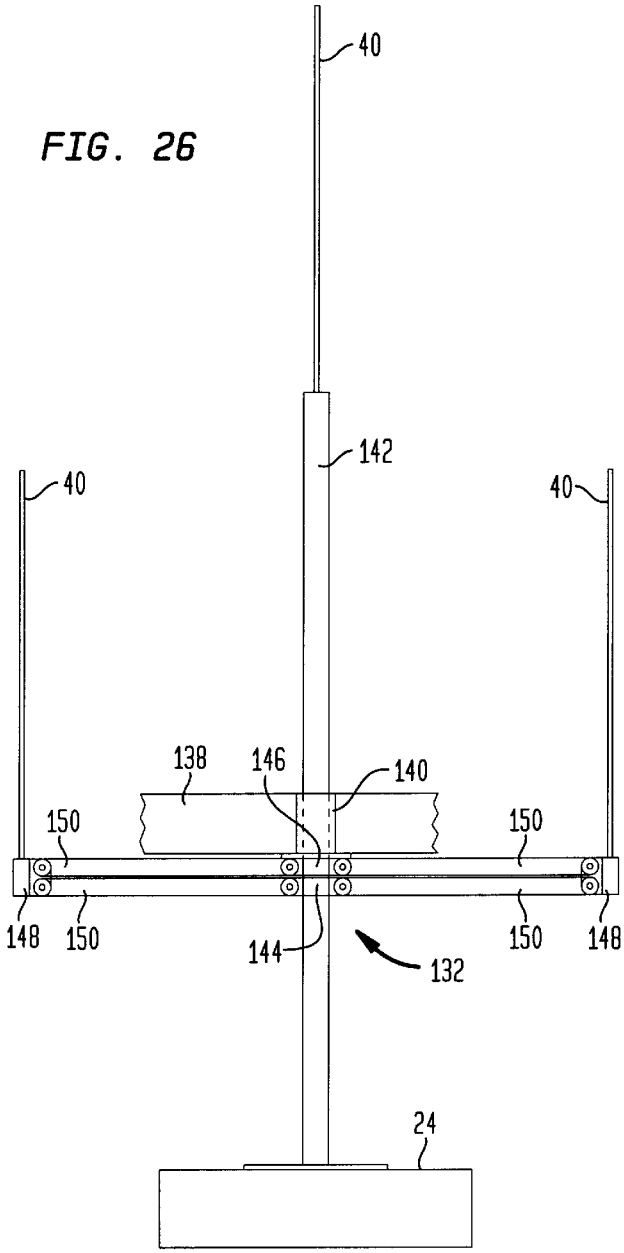
FIG. 26 is a side schematic view of the antenna deployer of the sixth embodiment in a deployed position.
Figure 25:
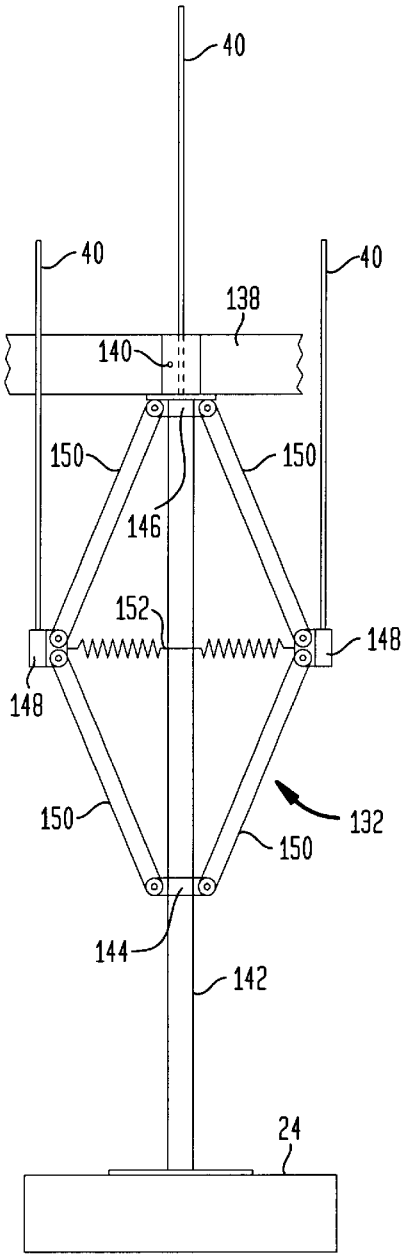
FIG. 25 is a side schematic view of an antenna deployer according to a sixth embodiment in a stowed position.
Figure 27:
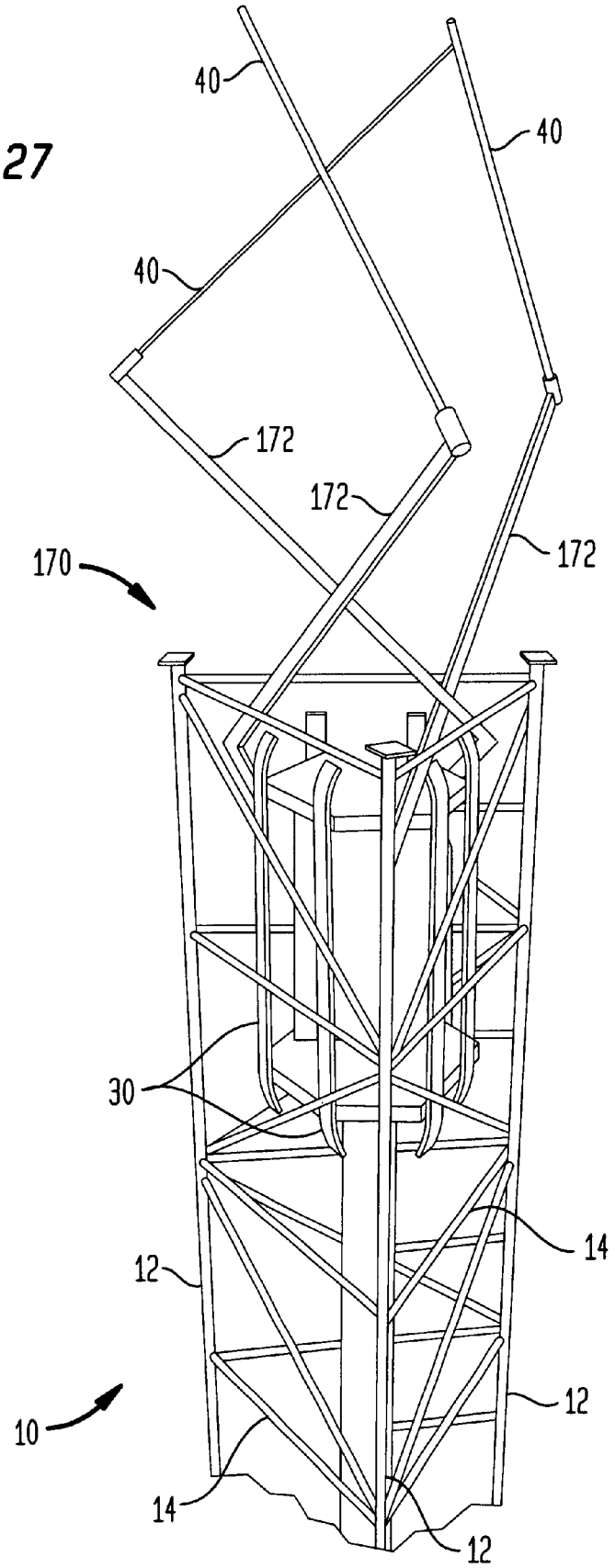
FIG. 27 is a perspective view showing a seventh embodiment of the present invention in a stowed position.
Figure 28:
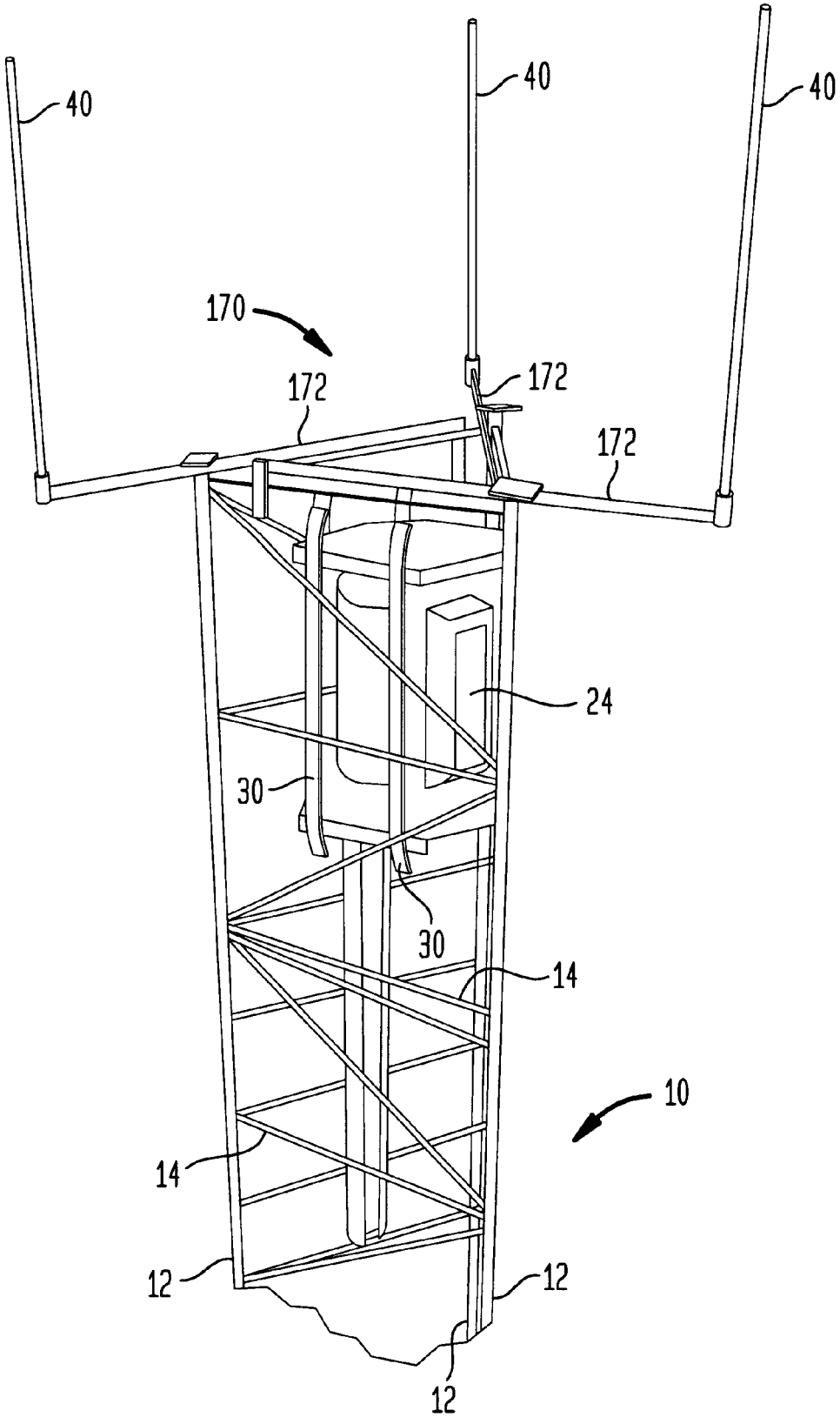
FIG. 28 is a perspective view of the seventh embodiment in a deployed position.

The antenna deployer 130 of the fifth embodiment shown in FIGS. 23 and 24 is configured slightly different from the antenna deployer 132 of the sixth embodiment shown in FIGS. 25 and 26, but operation is similar. In the antenna deployer 130 of the fifth embodiment shown in FIGS. 23 and 24, mid-portions of the linkage members 150 on each side of the support pole 142 are pivotally connected to form a pantograph mechanism. Additionally, the antenna support members 148 comprise a fixed portion 160 and a slidable collar portion 162. A spring (not shown in FIGS. 23 and 24) may be used to assist the movement of the antenna support members 148 to the stowed position upon lowering of the microcell 24. However, due to the geometry of the antenna deployer 130, the movement to the stowed position occurs due to gravity. Also, as shown in FIGS. 23–26, an additional antenna 40 or a lightning rod may be located at the top of the support pole 142 which may pass freely through the fixed ring 138 on the tower cross support 134.

An antenna deployer 170 according to a seventh embodiment of the present invention will now be described, with particular reference to FIGS. 27 through 30. In the seventh embodiment, three antennas 40 are affixed to the microcell 24. Accordingly, three antenna deployers 170 are utilized for moving the antennas 40 from the stowed position shown in FIG. 27 to the deployed position shown in The antenna deployer 132 according to the sixth embodiment shown in FIG. 25 includes a support pole 142 fixed to the upper portion of the microcell 24. A lower guide 144 is fixedly attached to the support pole 142, and an upper guide 146 is located above the lower guide 144 and which is slidable along the support pole 142. A pair of antenna support members 148 are located on opposite sides of the support pole 142. Linkage members 150 are located between the upper guide 146 and each of the antenna support members 148, and linkage members 150 are also located between the lower guide 144 and each of the antenna support members 148. The connection points between the linkage members 150 and tie upper guide 146, lower guide 144, and antenna support members 148 are freely pivotable. A tension spring 152 is arranged between the antenna support members 148 which tends to bias the antenna support members 148 toward one another so that the antennas 40 will tend to assume a stowed position. Alternatively, a compression spring may be arranged between the upper guide 146 and the lower guide 144 to bias he upper guide 146 and the lower guide 144 apart, whereby the antennas 40 will be biased toward one another to the stowed position.

Figure 29:
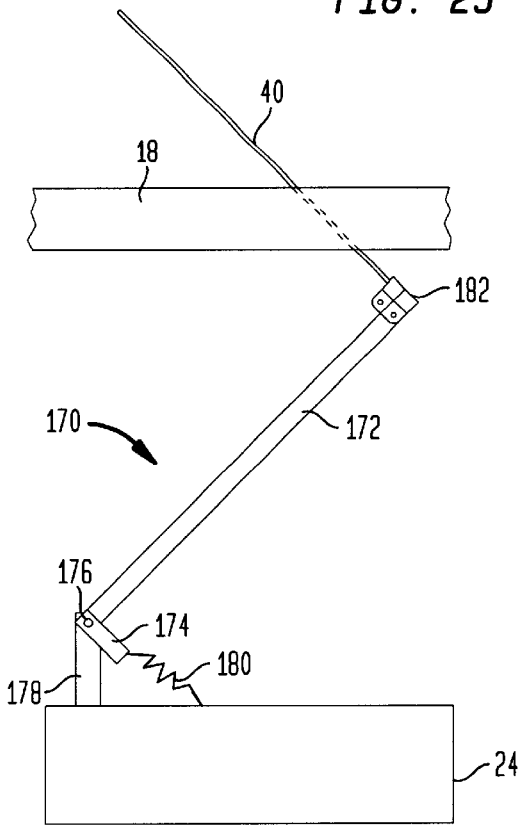
FIG. 29 is a side schematic view of the antenna deployer of the seventh embodiment in a stowed position.
Figure 30:
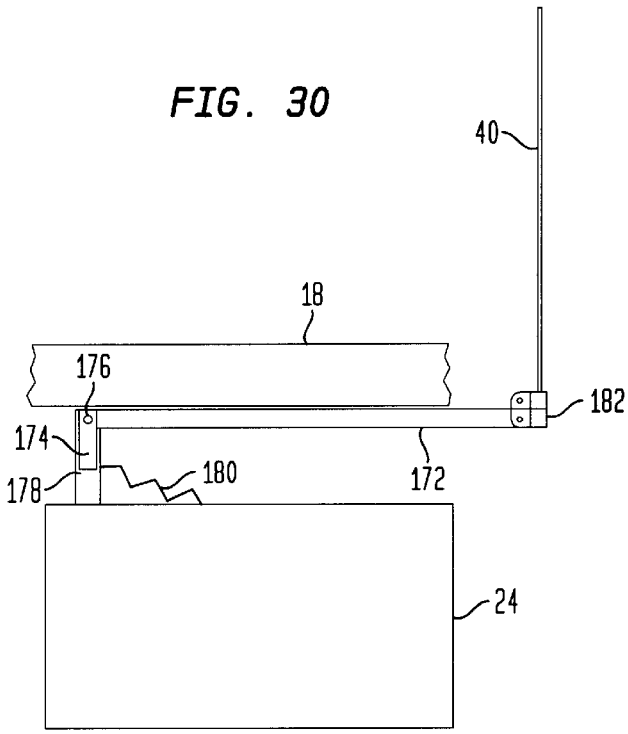
FIG. 30 is a side schematic view of the antenna deployer of the seventh embodiment in a deployed position.

To deploy the antennas 40, the microcell 24 is raised until a point is reached where the upper guide 146 contacts the ring 138 of the tower cross support 134, and further upward movement of the upper guide 146 is prohibited. However, the upper end of the support pole 142 may pass through the aperture 140 in the ring 138 and may be further elevated above the tower cross support 134. As the support pole 142 continues to move upwardly, the lower guide 144 also continues to move upwardly FIG. 28. Each antenna deployer 170 includes a horizontal arm member 172. The horizontal arm member 172 assumes a horizontal orientation only in the deployed position. However, the horizontal arm member 172 assumes approximately a 45° angle with respect to horizontal in the antenna stowed position, as shown in FIG. 29. One end of the horizontal arm member 172 includes a vertical arm member 174 fixedly attached thereto at a right-angle. A pivot 176 is located at the junction between the horizontal arm member 172 and the vertical arm member 174 for pivotally connecting the antenna deployer 170 to a vertical support member 178 extending upwardly from the upper surface of the microcell 24. The distal end of the vertical arm member 174 of the antenna deployer 170 is attached to one end of a tension spring 180. The other end of the tension spring 180 is fixed to the microcell 24. The opposite end of the horizontal arm member 172 includes an antenna support member 182 to which the antenna 40 is fixed.

As the microcell 24 is raised along the tower 10, the horizontal arm members 172 and the antennas 40 are oriented at approximately a 45° angle with respect to horizontal. As the microcell 24 is raised, the antennas pass above the cross support members 18 of the tower cross support 16, until a point is reached where the horizontal arm members 172 engage portions of the cross support members 18. Further upward movement of the microcell causes the horizontal arm members 172 to move downwardly against the abutting forces provided by the cross support members 18. As the horizontal arm members 172 move downwardly toward the horizontal position shown in FIG. 28, the tension springs 180 are stretched to increase the forces provided by the springs 180, until a point is reached where the microcell 24 is in an uppermost position and the antennas 40 are in the fully deployed position shown in FIGS. 28 and 30.

When it becomes necessary to lower the microcell 24, for example for maintenance or the like, the lowering of the microcell 24 allows the horizontal arm members 172 to move angularly upwardly, pivoting about the pivot 176 with the force being provided by the tension springs 180. Once the antennas 40 are in the stowed position, the microcell 24 can be filly lowered to the ground.

In each of the above embodiments, actuation of the antenna from the stowed position to the deployed position is accomplished by the interaction of the antenna deployer with a fixed member at the upper end of the tower. The antennas are automatically moved from the stowed position to the deployed position, and from the deployed position to the stowed position, without necessitating the use of additional motors for driving the antenna deployers. The deploying motion and collapsing motion is accomplished by the upward movement of the microcel 24, which upward movement is provided by a winch 22 and an associated cable 28.

Although the present invention has been described with a microcell 24 moving within the confines of the tower frame, it should be understood that the present invention may also be utilized with the antenna deployer and/or microcell 24 moving on the outside of the tower frame. Also, although the present invention has been described as utilizing deployers which utilize the upward movement of the microcell 24 to provide the actuation of the deployers to move the antennas 40 from the stowed position to the deployed position, it should be understood that other deploying mechanisms may be utilized which do not use the upward movement of the microcell to cause actuation. For example, a deploying mechanism may be utilized with the present invention whereby, once the antennas 40 have been raised to the desired position, a mechanism is actuated to deploy the antennas 40. The actuating mechanism may comprise an electrical switch, motor, solenoid, or spring-catch which may be activated by remotely pressing a button pulling a string, or otherwise signaling the actuating mechanism to deploy the antennas 40.

What has been described is merely illustrative of the application of the principles of the present invention. Those skilled in the art will recognize that these and various other modifications, arrangements and methods can be made to the present invention without strictly following the explanatory applications illustrated and described herein and without departing from the spirit and scope of the present invention.

What is claimed is:

1. An apparatus for deploying an antenna from a stowed position to a deployed position on a tower frame having a lower section and an upper section, said apparatus comprising:

a carrier supporting said antenna, said carrier being movable relative to said tower frame within an interior space of said tower frame in a direction toward said upper section; and an antenna deployer for deploying said antenna from said stowed position to said deployed position when said carrier reaches said upper section of said tower frame.

2. The apparatus according to claim 1, said antenna deployer comprising a pair of spaced-apart deploying devices for deploying a pair of antennas to deployed positions such that said antennas are spaced apart by a distance greater than a longest interior width dimension of said tower frame.

3. The apparatus according to claim 1, said antenna deployer converting longitudinal movement of said carrier into lateral deploying movement of said antenna.

4. The apparatus according to claim 1, further comprising an elevating device for moving said carrier from said lower section to said upper section.

5. The apparatus according to claim 4, said elevating device comprising a winch and cable mechanism.

6. The apparatus according to claim 1, said antenna deployer comprising:

a socket fixed to said carrier;

a first arm member partially received within said socket; and a second arm having one end fixed to said first am, and another end supporting said antenna.

7. The apparatus according to claim 1, said antenna deployer comprising:

a first arm rotatably secured to said carrier; and a second arm having one end pivotally attached to said first arm, and another end supporting said antenna.

8. The apparatus according to claim 7, further comprising a third arm having one end pivotally attached to said first arm, and another end supporting a second antenna.

9. The apparatus according to claim 1, said antenna deployer comprising:

a support pole attached to said carrier, said support pole including a lower guide member fixed thereto, and an upper guide member slidable therealong;

a first arm having a first end pivotally ached to said upper guide member;

a second arm having a first end pivotally attached to said lower guide member;

an antenna support member attached to one of said first arm and said second arm; and a connector pivotally interconnecting said first arm to said second arm.

10. The apparatus according to claim 9, said support pole including an antenna attached thereto.

11. The apparatus according to claim 9, said support pole including a lightning rod attached thereto.

12. The apparatus according to claim 9, said connector pivotally interconnecting a mid-portion of said first arm to a mid-portion of said second arm.

13. The apparatus according to claim 9, wherein said connector is fixed to said antenna support member.

14. The apparatus according to claim 9, wherein a second end of said first arm and a second end of said second arm are pivotally attached to said connector.

15. The apparatus according to claim 1, said antenna being located within an interior space of said tower frame when in said stowed position, and said antenna being opened laterally outside of said interior space when in said deployed position.

16. The apparatus according to claim 1, wherein said carrier includes said antenna deployer.

17. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said upper section of said tower frame including an actuating member for contacting a portion of said antenna deployer when said carrier reaches said upper section of said tower frame.

18. The apparatus according to claim 17, said actuating member comprising an abutment which prevents further upward movement of said portion of the antenna deployer.

19. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising a spring for biasing said antenna toward said stowed position.

20. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a socket fixed to said carrier;

a first arm member partially received within said socket;

a second arm having one end fixed to said first arm, and another end supporting said antenna;

at least one rectilinear slot located in a sidewall of said socket;

at least one helical slot located in a sidewall of said first arm; and an actuating disk located within said first arm, said actuating disk having at least one pin extending therefrom and located within an intersecting portion of said rectilinear slot and said helical slot.

21. The apparatus according to claim 20, said antenna deployer further comprising a spring located between said actuating disk and a bottom end of said first arm.

22. The apparatus according to claim 20, said upper section of said tower frame including an actuating member for contacting a portion of said antenna deployer when said carrier reaches said upper section of said tower frame, said actuating member comprising a rod extending from a cross support member of said tower frame, one end of said rod being receivable within said first arm for contacting and moving said actuating disk along said first arm, thereby causing said first arm to rotate as said helical slot follows said pin in said rectilinear slot.

23. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a socket fixed to said carrier;

a first arm member partially received within said socket;

a second arm having one end fixed to said first arm, and another end supporting said antenna;

at least one helical slot located in a sidewall of said first arm; and at least one pin extending inwardly from a sidewall of said socket, said pin being located within said helical slot.

24. The apparatus according to claim 23, said antenna deployer further comprising a spring located between a bottom end of said socket and a bottom end of said first arm.

25. The apparatus according to claim 23, said upper section of said tower frame including an actuate member for contacting a portion of said antenna deployer when said carrier reaches said upper section of said tower frame, said actuating member comprising a knob extending from a cross support member of said tower frame, said knob contacting and moving said first arm along said socket, thereby causing said first arm to rotate as said helical slot follows said pin in said socket.

26. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a socket fixed to said carrier;

a first arm member partially received within said socket;

a second arm having one end fixed to said first arm, and another end supporting said antenna;

at least one pin extending inwardly from an interior of said first arm; and an actuating member located at said upper section of said tower frame for contacting a portion of said antenna deployer when said carrier reaches said upper section of said tower frame, said actuating member comprising a rod extending from a cross support member of said tower frame, one end of said rod including at least one helical slot in a sidewall thereof, said one end of said rod being receivable within said first arm and movable therealong with said pin being located in said helical slot, thereby causing said first arm to rotate as said pin follows said helical slot.

27. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a first arm rotatably secured to said carrier;

a second arm having one end pivotally attached to said first arm, and another end supporting said antenna;

a socket fixed to said first arm; and at least one pin extending inwardly from an interior of said socket.

28. The apparatus according to claim 27, said upper section of said tower frame including an actuating member for contacting a portion of said antenna deployer when said carrier reaches said upper section of said tower frame, said actuating member comprising a rod extending from a cross support member of said tower frame, one end of said rod including at least one helical slot in a sidewall thereof, said one end of said rod being receivable within said socket and moveable therealong with said pin being located in said helical slot, thereby causing said first arm to rotate as said pin follows said helical slot.

29. The apparatus according to claim 28, further comprising at least one guide member attached to said tower frame for guiding said second arm into said deployed position as said first arm is rotated.

30. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a support pole attached to said carrier, said support pole including a lower guide member fixed thereto, and an upper guide member slidable therealong;

a first arm having a first end pivotally attached to said upper guide member;

a second arm having a first end pivotally attached to said lower guide member;

an antenna support member attached to one of said first arm and said second arm;

a connector pivotally interconnecting said first arm to said second arm; and a spring for biasing said antenna support member toward said support pole.

31. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a support pole attached to said carrier, said support pole including a lower guide member fixed thereto, and an upper guide member slidable therealong;

a first arm having a first end pivotally attached to said upper guide member;

a second arm having a first end pivotally attached to said lower guide member;

an antenna support member attached to one of said first arm and said second arm; and a connector pivotally interconnecting said first arm to said second arm, said upper section of said tower frame including an actuating member for contacting a portion of said antenna deployer when said carrier reaches said upper section of said tower frame, said actuating member comprising a ring having an aperture therein through which said support pole may slidably pass, said upper guide member abutting said ring, thereby preventing further upward movement of said upper guide member.

32. An apparatus for deploying an antenna from a stowed position to a deployed position on a tower frame having a lower section and an upper section, said apparatus comprising:

a carrier supporting said antenna, said carrier being movable relative to said tower frame in a direction toward said upper section; and an antenna deployer for deploying said antenna from said stowed position to said deployed position when said carrier reaches said upper section of said tower frame, said antenna deployer comprising:

a support member attached to said carrier;

a deployer arm having a first end portion pivotally attached to said support member and a second end portion supporting said antenna; and a spring connected between said deployer arm and said carrier for biasing said antenna toward said stowed position.

33. The apparatus according to claim 32, said deployer arm comprising a first arm and a second arm, said first arm supporting said antenna, said second arm having said spring connected thereto, wherein said first arm assumes approximately a 45° angle with respect to horizontal when said antenna is in said stowed position.

34. The apparatus according to claim 33, wherein said first arm is approximately horizontal when said antenna is in said deployed position.

35. The apparatus according to claim 33, said upper section of said tower frame including an actuating member for contacting a portion of said first arm when said carrier reaches said upper section of said tower frame to prevent further upward movement of said portion of said first arm.

36. A method of deploying an antenna from a stowed position to a deployed position on a tower frame, the antenna being supported by a carrier, said method comprising the following steps:

raising said carrier relative to said tower frame within an interior space of said tower frame with said antenna in said stowed position; and then deploying said antenna from said stowed position to said deployed position.

37. A method of deploying an antenna from a stowed position within an interior space of a tower frame to a deployed position where the antenna is opened laterally outside of the interior space, the antenna being mounted to a deploying mechanism supported by a carrier, said method comprising the following steps:

raising said carrier along said tower frame and within said interior space with said antenna in said stowed position;

contacting said deploying mechanism with a member located at an upper section of said tower frame; and deploying said antenna to said deployed position by further raising said carrier.

* * * * *